US011353254B2

(12) United States Patent
Hirokane

(10) Patent No.: US 11,353,254 B2
(45) Date of Patent: Jun. 7, 2022

(54) STATE CHANGE CONTROL DEVICE AND STATE CHANGE CONTROL METHOD

(71) Applicant: BLANCTEC Co., Ltd., Tokyo (JP)

(72) Inventor: Yoshio Hirokane, Tokyo (JP)

(73) Assignee: BLANCTEC CO., LTD., Tokyo (JP)

( * ) Notice: Subject to any disclaimer, the term of this patent is extended or adjusted under 35 U.S.C. 154(b) by 10 days.

(21) Appl. No.: 16/614,742

(22) PCT Filed: May 18, 2018

(86) PCT No.: PCT/JP2018/019330
§ 371 (c)(1),
(2) Date: Nov. 18, 2019

(87) PCT Pub. No.: WO2018/212335
PCT Pub. Date: Nov. 22, 2018

(65) Prior Publication Data

US 2020/0191462 A1 Jun. 18, 2020

(30) Foreign Application Priority Data

May 18, 2017 (JP) ..... JP2017-099144
May 18, 2017 (JP) ..... JP2017-099145

(51) Int. Cl.
*F25D 11/04* (2006.01)
*F25C 1/12* (2006.01)
(Continued)

(52) U.S. Cl.
CPC ..... *F25D 11/04* (2013.01); *F25C 1/12* (2013.01); *F25C 5/18* (2013.01); *F25D 17/02* (2013.01);
(Continued)

(58) Field of Classification Search
CPC .. F25D 11/04; F25D 2400/30; F25D 2331/00; F25D 17/02; F25C 1/12; F25C 5/18; A22B 5/0076
See application file for complete search history.

(56) References Cited

U.S. PATENT DOCUMENTS 6,857,284 B1 * 2/2005 Brooks ..... F25C 1/147 62/303
9,151,533 B2 * 10/2015 Brekke ..... F25D 13/065
(Continued)

FOREIGN PATENT DOCUMENTS

JP H02-213669 A 8/1990
JP H06109288 * 4/1994 ..... F24F 5/00
(Continued)

OTHER PUBLICATIONS

Jul. 31, 2018 Search Report issued in International Patent Application No. PCT/JP2018/019330.

*Primary Examiner* — Cassey D Bauer
(74) *Attorney, Agent, or Firm* — Oliff PLC

(57) ABSTRACT

A method efficiently changes the state of an object at low cost and in a short time, in which a state change control device changes the state of an object by bringing the object into contact with an ice slurry to cause a temperature change to the object. The device includes an ice slurry contact part that brings the object and the ice slurry into contact with each other at a predetermined relative speed and changes the temperature of the object, and an ice slurry supply part that supplies the ice slurry to the ice slurry contact part.

12 Claims, 13 Drawing Sheets

(51) Int. Cl.
*F25D 17/02* (2006.01)
*F25C 5/18* (2018.01)

(52) U.S. Cl.
CPC ..... *F25D 2331/00* (2013.01); *F25D 2400/30* (2013.01)

(56) References Cited

U.S. PATENT DOCUMENTS

| | | | | |
|---|---|---|---|---|
| 9,841,245 | B1 * | 12/2017 | Wright | A23B 4/064 |
| 10,149,486 | B2 * | 12/2018 | Hognason | A23B 4/09 |
| 2002/0194865 | A1 * | 12/2002 | Krylov | F25C 1/142 62/544 |
| 2011/0179812 | A1 * | 7/2011 | Goldstein | F25D 3/02 62/64 |
| 2018/0162627 | A1 | 6/2018 | Bessho et al. | |
| 2018/0325133 | A1 | 11/2018 | Hirokane et al. | |
| 2018/0340721 | A1 | 11/2018 | Hirokane et al. | |
| 2019/0024960 | A1 | 1/2019 | Hirokane et al. | |

FOREIGN PATENT DOCUMENTS

| | | | |
|---|---|---|---|
| JP | 2004-053142 | A | 2/2004 |
| JP | 2015-036605 | A | 2/2015 |
| JP | 2016-154453 | A | 9/2016 |
| JP | 2017-077925 | A | 4/2017 |
| JP | 6128452 | B1 | 5/2017 |
| JP | 6243092 | B2 | 12/2017 |
| JP | WO2017/086463 | A1 | 9/2018 |
| JP | 6487572 | B2 | 3/2019 |
| JP | 6488024 | B2 | 3/2019 |

* cited by examiner

FIG.13

| SALT CONCENTRATION | 0.0% | 1.0% | 2.0% | 5.0% | 10.0% | 15.0% | 20.0% | 23.5% |
|---|---|---|---|---|---|---|---|---|
| OUTSIDE TEMPERATURE | 23.9°C | 23.9°C | 23.9°C | 23.9°C | 23.9°C | 23.9°C | 23.9°C | 23.9°C |
| LOW PRESSURE | 0.13MPa | 0.13MPa | 0.13MPa | 0.12MPa | 0.02MPa | 0.02MPa | 0.00MPa | 0.00MPa |
| HIGH PRESSURE | 1.40MPa | 1.40MPa | 1.42MPa | 1.40MPa | 1.40MPa | 1.40MPa | 1.50MPa | 1.51MPa |
| FREEZING MACHINE OPERATING FREQUENCY | 28.19Hz | 28.19Hz | 28.19Hz | 28.19Hz | 67.46Hz | 67.46Hz | 67.46Hz | 67.46Hz |
| SUCTION TEMPERATURE | -3.7°C | -4.5°C | -5.3°C | -8.1°C | -32.4°C | -35.2°C | -36.5°C | -40.1°C |
| RAW WATER TEMPERATURE | 12.0°C | 12.0°C | 12.0°C | 12.0°C | 12.0°C | 12.0°C | 12.0°C | 12.0°C |
| BLADE REDUCER OPERATING FREQUENCY | 120.00Hz | 106.20Hz | 110.70Hz | 120.00Hz | 93.50Hz | 73.10Hz | 53.13Hz | 53.32Hz |
| MEASURED WEIGHT (FIRST MEASUREMENT) | 0.42kg/l | 0.48kg/l | 0.49kg/l | 0.57kg/l | 0.64kg/l | 0.70kg/l | 0.72kg/l | 0.75kg/l |
| MEASURED WEIGHT (SECOND MEASUREMENT) | 0.47kg/l | 0.51kg/l | 0.54kg/l | 0.63kg/l | 0.66kg/l | 0.70kg/l | 0.72kg/l | 0.78kg/l |
| MEASURED WEIGHT (THIRD MEASUREMENT) | 0.45kg/l | 0.50kg/l | 0.53kg/l | 0.60kg/l | 0.62kg/l | 0.69kg/l | 0.74kg/l | 0.76kg/l |
| MEASURED WEIGHT (AVERAGE VALUE) | 0.45kg/l | 0.50kg/l | 0.52kg/l | 0.60kg/l | 0.64kg/l | 0.70kg/l | 0.73kg/l | 0.76kg/l |
| BULK DENSITY | 0.45g/cm$^3$ | 0.50g/cm$^3$ | 0.52g/cm$^3$ | 0.60g/cm$^3$ | 0.64g/cm$^3$ | 0.70g/cm$^3$ | 0.73g/cm$^3$ | 0.76g/cm$^3$ |
| TEMPERATURE OF ICE | 0.0°C | -1.0°C | -2.0°C | -6.3°C | -13.7°C | -19.9°C | -20.5°C | -21.0°C |
| VOID RATIO (CALCULATED VALUE) | 51.1% | 46.2% | 44.6% | 37.9% | 36.8% | 33.9% | 33.8% | 33.1% |

STATE CHANGE CONTROL DEVICE AND STATE CHANGE CONTROL METHOD

TECHNICAL FIELD

The present invention relates to a state change control device and a state change control method.

BACKGROUND ART

Conventionally, for transporting freight, such as fresh marine products, in a frozen state, a reefer container provided with a freezing machine for maintaining a temperature in a refrigerator, a freezer container containing plural frozen cold storage agents disposed in a refrigerator, and the like have been used.

However, in the reefer container, it is required to provide space for disposing equipment, such as the freezing machine, a ventilation unit and the like, in the refrigerator; therefore, space for placing the freight is limited. In addition, of course, large amounts of power is required for driving the freezing machine and the like.

For this reason, for transporting frozen fresh marine products and the like, the freezer container disposing frozen cold storage agents in a refrigerator is often used from the viewpoint of securing the space for placing the freight or power costs.

However, since the cold storage agent used in the freezer container is melted and the cooling capacity thereof is decreased with time, it is necessary to perform a process of refreezing after the freight is transported. Therefore, the process of refreezing a large number of cold storage agents with the cooling capacity decreased as melting is continuously performed.

With regard to the process of refreezing the cold storage agents, although it depends on the size thereof, about 5,000 to 10,000 cold storage agents are subjected to the refreezing process at one location in some cases. As a concrete method of refreezing the cold storage agent, an air blast (air refrigeration) method is commonly used (refer to Patent Document 1 and Patent Document 2). The air blast (air refrigeration) method is the most common refrigeration method that decreases a temperature in a freezer by blowing cold air into the freezer, to thereby perform freezing, and, for example, for a freezing chamber of a home-use refrigerator, the air blast (air refrigeration) method is adopted.

Moreover, for defrosting frozen fresh marine products, a method of natural defrosting at a room temperature or by use of a refrigerator, a method of defrosting the frozen fresh marine products by immersing thereof in cold water or iced water, a method of defrosting by use of a microwave oven, and so forth, have been conventionally used.

However, in the case of natural defrosting or defrosting by use of the cold water or the iced water, since the temperature difference between the frozen fresh marine products and a heating medium (air at the room temperature, the cold water or the iced water) is small, there is a possibility that defrosting takes a longer time and quality of the fresh marine products is decreased. On the contrary, if running water defrosting is performed by using warm water for reducing defrosting time, there is a possibility that the cells of the fresh marine products are broken.

To solve the above-described problems, Patent Document 3 describes a defrosting method of frozen food using sherbet ice as a defrosting medium. Specifically, Patent Document 3 suggests a method that immerses a fish frozen in a vacuum-packed state in the sherbet ice (fine fluidized ice) to defrost the fish by transferring heat from the fish to iced water in accordance with a difference between the temperature of the fish and the temperature of the iced water.

CITATION LIST

Patent Literature

Patent Document 1: Japanese Unexamined Patent Application, Publication No. 2017-077925

Patent Document 2: Japanese Unexamined Patent Application, Publication No. 2015-036605

Patent Document 3: Japanese Unexamined Patent Application, Publication No. 2016-154453

SUMMARY OF INVENTION

Technical Problem

However, in the freezing techniques by the conventional air blast (air refrigeration) method including the techniques disclosed in Patent Document 1 and Patent Document 2, it is necessary to cool cold storage agents by cold air of about −40° C. for about eight hours for freezing the cold storage agents. This requires large amounts of energy, such as power or the like, and time for generating the cold air.

In other words, in the case where the freight is transported while being cooled by use of the cold storage agents, although a large amounts of energy, such as power, is not required in a freezer container like the reefer container, large amounts of energy, such as power, is needed to cool the cold storage agents themselves. In addition, since it is required to wait for about eight hours for freezing the cold storage agents, there is a problem of significant time constraints even though the number of cold storage agents to be frozen is tried to be increased.

Moreover, in the defrosting method of frozen food described in Patent Document 3, the fine ice of sherbet ice in contact with the frozen fish grows while converting water in contact with itself to ice by cold energy taken from the frozen fish, to thereby bring an entire fish into a state of being covered with fine sherbet ice. In addition, the water in contact with the fish is similarly converted into the ice.

That is, in the defrosting method of frozen food described in Patent Document 3, on the surface of the frozen fish, water portion (liquid portion) of the sherbet ice in contact with the surface is cooled and solidified, to thereby adhere to the surface of the fish as ice (frost). At this time, the ice (frost) adhering to the surface of the fish is generated from the portion of water (fresh water) that does not contain any solute (for example, common salt). This is because an aqueous solution in which a solute, such as common salt, is dissolved is rarely frozen uniformly as is, and the portion of the fresh water that does not contain the solute (for example, the common salt) is frozen at first.

For this reason, in the defrosting method of frozen food described in Patent Document 3, even though the frozen fish is immersed in sherbet ice using salt water, on the surface of the frozen fish, the portion of fresh water of the sherbet ice is frozen earlier and adheres to the surface as ice (frost). At this time, since the ice (frost) adhering to the surface of the fish, which is in the state of being frozen at −20° or less, is the ice solidified from fresh water, the ice constitutes a membrane of ice (frost) having a temperature lower than that of sherbet ice from salt water, to thereby wrap the fish.

Due to the membrane of low-temperature ice (frost), the fish and the sherbet ice cannot directly contact with each other, and thereby it becomes impossible to efficiently defrost the fish by the sherbet ice from the salt water.

The present invention has been made in view of such circumstances, and an object of the present invention is to provide a method for efficiently changing the state of an object at low cost and in a short time. More specifically, an object of the present invention is to provide a method for efficiently cooling an object at low cost and in a short time, and a method for efficiently defrosting the object at low cost and in a short time without generating ice (frost) on a surface portion of the frozen object.

Solution to Problem

To achieve the above-described object, a state change control device according to an embodiment of the present invention changes a state of an object by bringing the object into contact with an ice slurry to cause a temperature change to the object, the device including: an ice slurry contact unit bringing the object into contact with the ice slurry at a predetermined relative speed to change a temperature of the object; and an ice slurry supply unit supplying the ice slurry to the ice slurry contact unit.

Moreover, an ice slurry circulation unit circulating the ice slurry by feeding the ice slurry to the ice slurry contact unit and returning the ice slurry discharged from the ice slurry contact unit to the ice slurry contact unit can be further provided, and thereby the ice slurry contact unit can bring the ice slurry fed by the ice slurry circulation unit into contact with the object at the predetermined relative speed.

In addition, the ice slurry contact unit can further include an object oscillation unit vibrating or oscillating the object.

Moreover, the object may be a cold storage agent and the state change may be solidification caused by cooling the cold storage agent.

In addition, the object may be a frozen food and the state change may be melting caused by absorbing cold energy of the food.

Moreover, the ice slurry supply unit can further include: a flake ice production unit producing flake ice constituting the ice slurry; and an ice slurry production unit producing the ice slurry by mixing the flake ice produced by the flake ice production unit with brine at a predetermined ratio, and the flake ice production unit includes an ice making surface and an ice making surface cooling unit, the flake ice production unit producing the flake ice by peeling off ice of the brine made by attaching the brine to the cooled ice making surface to freeze thereof.

Moreover, a brine extraction unit can be further provided, the unit extracting the brine contained in the ice slurry and providing the brine to at least one of the flake ice production unit and the ice slurry production unit as a raw material used for producing the flake ice or the ice slurry.

In addition, a flake ice extraction unit can be further provided, the unit extracting the flake ice contained in the ice slurry and providing the flake ice to the ice slurry production unit as a raw material used for producing the ice slurry.

A state change control method for an object by use of the state change control device, which is an embodiment of the present invention, causes a state change to the object by use of the state change control device, which is the above-described embodiment of the present invention.

Advantageous Effects of Invention

According to the present invention, it is possible to provide a method for efficiently changing the state of an object at low cost and in a short time.

BRIEF DESCRIPTION OF DRAWINGS

FIG. 13 is a diagram showing experimental results related to a bulk density (a void ratio) of flake ice (hybrid ice) under various kinds of conditions.

DESCRIPTION OF EMBODIMENTS

<Ice>

Figure 1:
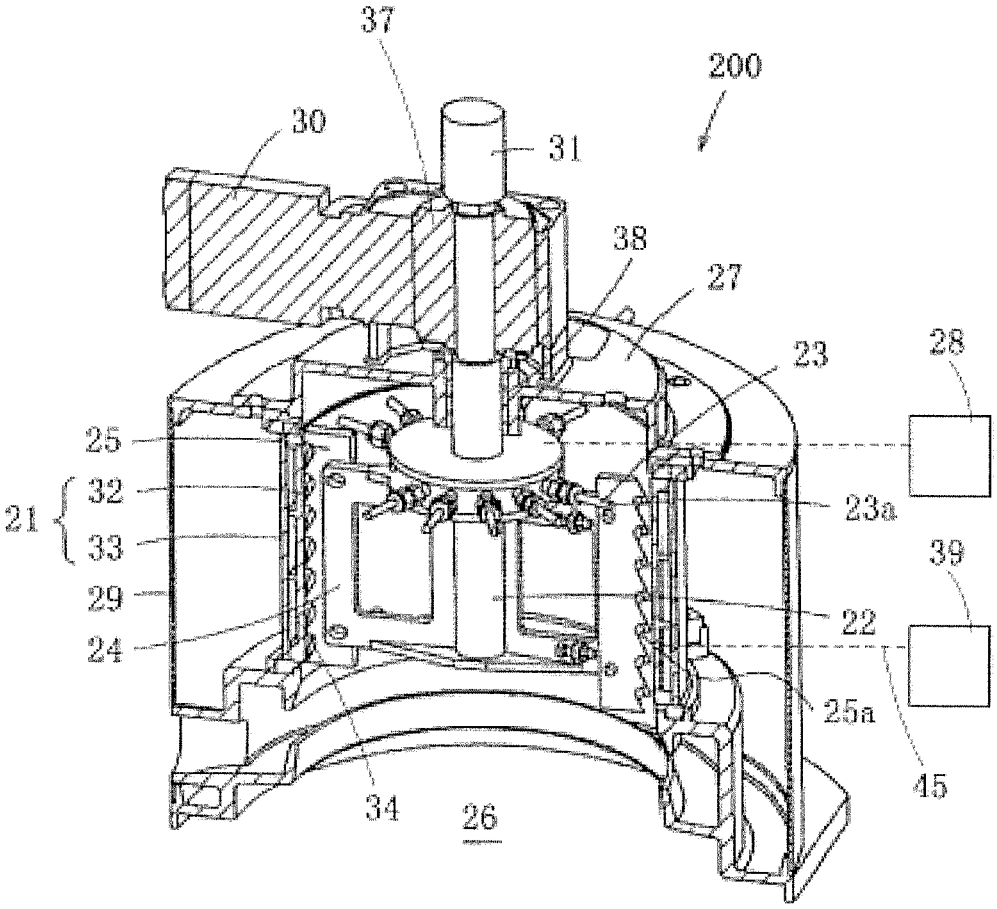
FIG. 1 is an image view including a partial, perspective cross-sectional view showing an outline of an existing flake ice production device.

Ice to be used in the state change control device according to the present invention is generated by solidifying an aqueous solution (also referred to as brine) containing a solute so that the concentration of the solute is substantially uniform, and satisfies at least the following conditions (a) and (b) (hereinafter, referred to as "hybrid ice"):

(a) the temperature of the ice after melting completely is lower than 0° C.; and (b) a rate of change of the solute concentration in an aqueous solution (brine) to be generated from the ice in the melting process is 30% or less.

Here, "brine" means an aqueous solution having a low solidifying point. Specifically, examples of the brine include an aqueous solution of sodium chloride (salt water), an aqueous solution of calcium chloride, an aqueous solution of magnesium chloride and ethylene glycol.

The hybrid ice can take large amounts of latent heat from the environment when being melted, but the temperature thereof does not rise while the hybrid ice is not completely melted and remained. Accordingly, the hybrid ice can continuously cool a material to be cooled for a long time.

Moreover, the ice slurry, which will be described later, made by mixing the hybrid ice and the brine can take large amounts of cold energy from the environment when the liquid portion (the brine portion) is solidified, but unless the liquid portion (the brine portion) is not completely frozen, the temperature of the ice slurry does not decrease. Accordingly, the hybrid ice can continuously absorb the cold energy from a material to be defrosted for a long time.

Note that a material serves as a target of state change (for example, solidification by freezing, melting by defrosting) caused by temperature change by use of the hybrid ice or the ice slurry is hereinafter referred to as an "object." In addition, especially, an object to be cooled is hereinafter referred to as a "cooling object," and an object to be defrosted by absorbing cold energy thereof is hereinafter referred to as a "defrosting object."

The hybrid ice is generated during the process of producing flake ice by a flake ice production device 200 to be described later.

Since the hybrid ice contains fine void portions (in other words, portions of air) in a state of being produced as the flake ice, the void portions are freely coupled with one another in the hybrid ice; therefore, the ice can be prepared in a snow-like form or in a sherbet-like form.

Air (gas) in the void portions of the hybrid ice has a feature that, when the hybrid ice and the brine are mixed, the air can be easily replaced with the brine (liquid).

In particular, the hybrid ice prepared in the snow-like forms or the sherbet-like forms is provided with flexibility as a whole, and thereby the ice does not damage the object, but rather, the ice has a role of a sponge for protecting the object as a buffer material.

In addition, even in the state of having a large number of void portions (portions of air) or in the state in which the void portions are filled with the brine by melting of the hybrid ice, the hybrid ice as a whole is able to keep sufficient fluidity (flexibility). For this reason, the hybrid ice can efficiently cool or defrost an object. For example, in the case where the frozen object is to be defrosted by being immersed in iced water as before, the temperature differs between an upper portion of the iced water where ice is floating and a lower portion of full of water and little amount of ice, and thereby quality of the defrosted object is different depending on portions thereof in some cases. In contrast thereto, in the case where the frozen object is immersed in the hybrid ice, the entirety of which is prepared in the snow-like forms or in the sherbet-like forms to be defrosted, difference in quality caused depending on portions as described above does not occur.

Here, in the case where the proportion of the volume of the void portions (portions of air) to the volume of the entire hybrid ice is defined as a "void ratio," the less the void ratio (in other words, the more the bulk density), the higher the cold storage effect. By use of such characteristics, the void ratio of the hybrid ice may be appropriately changed in accordance with characteristics or application purposes of an object. This makes it possible to generate the hybrid ice to be optimum according to characteristics or application purposes of an object.

Specifically, for example, in the case where the hybrid ice is used for the purpose of cold storage or refrigeration of fresh foods, the hybrid ice with a high void ratio (in other words, a low bulk density) may be generated.

Moreover, in the case where the hybrid ice is used for the purpose of transporting the cold energy, the hybrid ice with a low void ratio (in other words, a high bulk density) may be generated.

In addition, the specific surface area of the hybrid ice can be increased by processing the hybrid ice into flake (thin section)-like forms. Note that the hybrid ice processed into such flake (thin section)-like forms is hereinafter referred to as "flake ice." The flake ice is produced by a flake ice production device 200 to be described later.

Moreover, the mixture of the flake ice and the brine before being frozen is hereinafter referred to as "ice slurry." Since the ice slurry has fluidity, the ice slurry can be brought into contact an object evenly as compared to the state of hard flake ice.

Note that addition of the flake ice (solid) to the ice slurry makes it possible to easily adjust the component ratio of the flake ice (solid) and the brine (liquid) contained in the ice slurry.

In addition, while the thermal conductivity of the brine containing common salt as the solute (salt water) is about 0.58 W/mK, the thermal conductivity of the flake ice made by freezing the brine containing common salt as the solute is about 2.2 W/mK. That is to say, since the thermal conductivity of the flake ice (solid) is higher than that of the brine (liquid), the flake ice (solid) can cause the state change to the object earlier.

However, in the form of the flake ice (solid), the contact area with the object is small. Therefore, mixture of the flake ice and the brine to bring about the state of the ice slurry, the fluidity is provided. This enables the flake ice (solid) to be evenly brought into contact with the object and to cause the state change to the object rapidly.

Here, to describe specific figures of the bulk density of the hybrid ice, the bulk density definable as the hybrid ice is from 0.48 g/cm$^3$ to 0.78 g/cm$^3$.

In addition, in the case where the hybrid ice is used for the purpose of cold storage of the fresh foods, it is preferable to set the bulk density from 0.48 g/cm$^3$ to 0.54 g/cm$^3$.

Moreover, in the case where the hybrid ice is used for the purpose of refrigeration of the fresh foods, it is preferable to set the bulk density from 0.69 g/cm$^3$ to 0.78 g/cm$^3$.

Alternatively, in the case where the hybrid ice is used for the purpose of transporting the cold energy, the bulk density may be set at 0.75 g/cm$^3$ to 0.95 g/cm$^3$ by further compressing ice from saturated saline mechanically.

It is conventionally known that, when a solute is dissolved in a solvent, the solidifying point of the aqueous solution is lower than the solidifying point of the solvent before dissolving the solute (solidifying point depression). In other words, ice obtained by freezing an aqueous solution dissolving a solute, such as common salt, is frozen at a lower temperature (namely, less than 0° C.) than ice obtained by freezing fresh water (namely, water in which any solute, such as common salt, is not dissolved).

Here, the heat required when ice as a solid converts (melts) to water as a liquid is called "latent heat." Since the latent heat is not accompanied by a temperature change, the hybrid ice can be sustained in a stable state at a temperature less than the solidifying point of fresh water (0° C.) at the time of melting. Therefore, a state in which the cold energy is saved can be sustained. Moreover, similarly, since the hybrid ice can be sustained in a stable state at a temperature less than the solidifying point of fresh water (0° C.) at the time of freezing, a state in which the cold energy is saved can be sustained.

As described above, the hybrid ice is [ice] having the solidifying point less than the solidifying point of fresh water (0° C.), but producing thereof is not easy. In other words, if ice made by freezing an aqueous solution dissolving a solute, such as common salt, is to be produced, the aqueous solution (for example, salt water) is rarely frozen as is in actuality, and the portion of the fresh water that does not contain the solute (common salt or the like) is frozen at first. For this reason, the material generated as a result of freezing an aqueous solution dissolving a solute, such as common salt, is a mixture of ice made by freezing fresh water that does not contain any solute (common salt or the like) and a solute (for example, crystals of common salt or the like). In addition, even though ice having a decreased solidifying point (ice made by freezing salt water or the like) is generated, the amount thereof is very little and there is no practical application.

Consequently, conventional arts could not produce the ice having low solidifying point with ease.

Therefore, the inventor of the present invention and others have succeeded in producing ice having high cooling capacity (hybrid ice) made by freezing an aqueous solution having a low solidifying point (brine) by a predetermined method (details thereof will be described later), and have already filed plural patent applications (for example, Japanese Patent Application No. 2016-103637).

Hereinafter, the above-described conditions (a) and (b) satisfied by the hybrid ice will be described.

<Temperature of Ice after Melting Completely>

Of the conditions regarding the hybrid ice, the above-described (a) is a condition that the temperature of the ice after melting completely is less than 0° C. Since the hybrid ice is made from an aqueous solution (salt water or the like) including a solute (common salt or the like), the solidifying point of the hybrid ice is lower than the solidifying point of fresh water which does not include a solute. For this reason, the hybrid ice has a feature that the temperature thereof after melting completely is less than 0° C. Note that the "temperature of the hybrid ice after melting completely" refers to the temperature of an aqueous solution (brine) at the time point at which the entire hybrid ice melts to the aqueous solution after melting of the hybrid ice is started by putting the hybrid ice in an environment at a temperature equal to or higher than the melting point (for example, at room temperature and atmospheric pressure).

Moreover, the temperature of the hybrid ice after melting completely is not particularly limited as long as it is less than 0° C., and the temperature can be appropriately changed by adjusting the kind and concentration of the solute. However, it is more preferable as the temperature of the hybrid ice after melting completely is lower from the viewpoint of a higher cooling capacity, and specifically, the temperature is preferably −1° C. or lower (−2° C. or lower, −3° C. or lower, −4° C. or lower, −5° C. or lower, −6° C. or lower, −7° C. or lower, −8° C. or lower, −9° C. or lower, −10° C. or lower, −11° C. or lower, −12° C. or lower, −13° C. or lower, −14° C. or lower, −15° C. or lower, −16° C. or lower, −17° C. or lower, −18° C. or lower, −19° C. or lower, −20° C. or lower, and the like).

Meanwhile, there is also a case in which it is preferable to bring the solidifying point closer to the freezing point of the object. For example, in the case where there is a reason, such as to prevent damage to fresh plants/animals, it is preferable that the temperature of the hybrid ice after melting completely is not too high, and for example, the temperature is preferably −21° C. or higher (−20° C. or higher, −19° C. or higher, −18° C. or higher, −17° C. or higher, −16° C. or higher, −15° C. or higher, −14° C. or higher, −13° C. or higher, −12° C. or higher, −11° C. or higher, −10° C. or higher, −9° C. or higher, −8° C. or higher, −7° C. or higher, −6° C. or higher, −5° C. or higher, −4° C. or higher, −3° C. or higher, −2° C. or higher, −1° C. or higher, −0.5° C. or higher, and the like).

<Rate of Change of Solute Concentration>

Of the conditions regarding the hybrid ice, the above-described (b) is a condition that a rate of change of the solute concentration in an aqueous solution to be generated from the ice in the melting process is 30% or less. The hybrid ice has a feature that a rate of change of the solute concentration in an aqueous solution to be generated from the ice in the melting process (hereinafter abbreviated as the "rate of change of the solute concentration" in some cases in the present specification) is 30% or less. There is also a case in which ice having a decreased solidifying point is slightly generated even in a method conventionally existing, but most of the ice is merely a mixture of ice from water which does not include a solute and the crystal of the solute and thus it does not have a sufficient cooling capacity and capacity to absorb the cold energy. In a case in which a mixture of ice from water which does not include a solute and the crystal of the solute is contained in ice in this manner, the elution speed of the solute accompanying melting is unstable in the case of putting the ice under the melting conditions. Specifically, a more amount of the solute elutes as the time point is closer to the time of start of melting. Then, the amount of the solute to elute decreases as the melting proceeds. In other words, the amount of the solute eluted decreases as the time point is closer to the time of completion of melting.

In contrast, since the hybrid ice is made by freezing an aqueous solution including a solute, the hybrid ice has a feature that the change of the elution speed of the solute in the melting process is small. Specifically, the rate of change of the solute concentration of the aqueous solution to be generated from the hybrid ice in the melting process thereof is 30%. Here, the "rate of change of the solute concentration of the aqueous solution to be generated by melting of the hybrid ice in the melting process" means the proportion of the concentration of the aqueous solution at the time of completion of melting to the concentration of the solute in the aqueous solution to be generated at an arbitrary time point in the melting process. Note that the "solute concentration" means the concentration of the mass of the solute melted in the aqueous solution.

The rate of change of the solute concentration in the hybrid ice is not particularly limited as long as the rate is 30% or less, but it means that the hybrid ice is of higher purity, that is, the cooling capacity and capacity to absorb the cold energy are higher as the rate of change of the solute concentration is smaller.

From this viewpoint, it is preferable that the rate of change of the solute concentration is 25% or less (24% or less, 23% or less, 22% or less, 21% or less, 20% or less, 19% or less, 18% or less, 17% or less, 16% or less, 15% or less, 14% or less, 13% or less, 12% or less, 11% or less, 10% or less, 9% or less, 8% or less, 7% or less, 6% or less, 5% or less, 4% or less, 3% or less, 2% or less, 1% or less, 0.5% or less, and the like). On the other hand, the rate of change of the solute concentration may be 0.1% or more (0.5% or more, 1% or more, 2% or more, 3% or more, 4% or more, 5% or more, 6% or more, 7% or more, 8% or more, 9% or more, 10% or more, 11% or more, 12% or more, 13% or more, 14% or more, 15% or more, 16% or more, 17% or more, 18% or more, 19% or more, 20% or more, and the like).

<Solute>

The kind of solute to be contained in the hybrid ice is not particularly limited as long as it is a solute when water is used as a solvent, and it can be appropriately selected depending on the desired solidifying point, the application purpose of ice to be used, and the like. Examples of the solute may include a solid solute and a liquid solute, and examples of a typical solid solute may include salts (inorganic salts, organic salts, and the like). Particularly, common salt (NaCl) among the salts is suitable to cool or defrost fresh plants/animals or portions thereof because the temperature of solidifying point is not excessively decreased. In addition, the common salt is suitable from the viewpoint of easy procurement as well since it is contained in seawater. In addition, examples of the liquid solute may include ethylene glycol. Note that the solute may be contained singly, or two or more kinds thereof may be contained.

The concentration of the solute contained in the hybrid ice is not particularly limited, and the concentration can be appropriately selected depending on the kind of solute, the desired solidifying point, the application purpose of the hybrid ice, and the like. For example, in the case of using common salt as a solute, it is preferable that the concentration of common salt is 0.5% (w/v) or more (1% (w/v) or more, 2% (w/v) or more, 3% (w/v) or more, 4% (w/v) or more, 5% (w/v) or more, 6% (w/v) or more, 7% (w/v) or more, 8% (w/v) or more, 9% (w/v) or more, 10% (w/v) or more, 11% (w/v) or more, 12% (w/v) or more, 13% (w/v) or more, 14% (w/v) or more, 15% (w/v) or more, 16% (w/v) or more, 17% (w/v) or more, 18% (w/v) or more, 19% (w/v) or more, 20% (w/v) or more, and the like) from the viewpoint of decreasing the solidifying point of the aqueous solution and thus being able to obtain a high cooling capacity.

On the other hand, it is preferable not to excessively decrease the temperature of solidifying point in the case of using the hybrid ice for cooling fresh plants/animals or portions thereof, and it is preferable that the concentration of the common salt is 23% (w/v) or less (20% (w/v) or less, 19% (w/v) or less, 18% (w/v) or less, 17% (w/v) or less, 16% (w/v) or less, 15% (w/v) or less, 14% (w/v) or less, 13% (w/v) or less, 12% (w/v) or less, 11% (w/v) or less, 10% (w/v) or less, 9% (w/v) or less, 8% (w/v) or less, 7% (w/v) or less, 6% (w/v) or less, 5% (w/v) or less, 4% (w/v) or less, 3% (w/v) or less, 2% (w/v) or less, 1% (w/v) or less, and the like) from the viewpoint.

Since the hybrid ice has the excellent cooling capacity and capacity to absorb the cold energy, the hybrid ice is suitable for use as a refrigerant for cooling the object to freeze thereof, or for efficiently absorbing cold energy from a frozen object. Note that, other than the hybrid ice, examples of a low-temperature refrigerant may include an organic solvent to be used as an anti-freezing solution such as ethanol. However, the hybrid ice has a higher thermal conductivity and a higher specific heat than these anti-freezing solutions. For this reason, the hybrid ice is useful in the point of having a superior cooling capacity and capacity to absorb the cold energy to other refrigerants at lower than 0° C., such as the anti-freezing solution as well.

Note that the hybrid ice may or may not contain components other than the solute described above (common salt and the like).

<Refrigerant for Cooling Object>

As described above, the hybrid ice is suitable as a refrigerant for cooling an object to freeze thereof since the hybrid ice has the excellent cooling capacity. In particular, a mixture (ice slurry) made by mixing the flake ice, which is the hybrid ice processed into the flake-like form, and the brine at a predetermined ratio to have the sherbet-like form is provided with an increased area to be brought into contact with an object. Therefore, it is possible to efficiently cool and freeze an object, and efficiently absorb the cold energy from a frozen object.

Note that, to prevent confusion between a "refrigerant" for cooling and freezing an object or absorbing cold energy from a frozen object and a "refrigerant" shown in FIG. 4 that is supplied to a refrigerant clearance 34 for cooling an inner peripheral surface of an inner cylinder 32 of the flake ice production device 200, the refrigerant for cooling and freezing an object is hereinafter referred to as the "ice slurry," and the refrigerant supplied to the refrigerant clearance 34 is referred to as an "inner cylinder cooling refrigerant."

The flake ice contained in the ice slurry and the brine contain the same solute, and at this time, it is preferable that values of solute concentration of the flake ice and solute concentration of the brine are close to each other. The reason is as follows.

In a case where the solute concentration of the flake ice is higher than the solute concentration of the brine, the temperature of the flake ice is lower than the saturated freezing point of the brine and thus the brine freezes immediately after the brine having a lower solute concentration is mixed with the flake ice.

On the other hand, in a case where the solute concentration of the flake ice is lower than the solute concentration of the brine, the saturated freezing point of the brine is lower than the saturated freezing point of the flake ice. Therefore, the temperature of the ice slurry made by mixing the flake ice and the brine decreases. In other words, in order not to change the state of the mixture of the flake ice and the brine (state of the ice slurry), as described above, it is preferable to set the solute concentrations of the flake ice and the brine to be mixed to be about the same.

In addition, in the case of the ice slurry, the brine may be one generated as the flake ice melts or one separately prepared, but the brine is preferably one generated as the flake ice melts.

Specifically, in the case where the ice slurry containing the flake ice is composed of a mixture of the flake ice and the brine, the ratio of the solute concentration in the flake ice to the solute concentration in the brine is more preferably from 75:25 to 20:80, still more preferably from 70:30 to 30:70, yet more preferably from 60:40 to 40:60, yet still more preferably from 55:45 to 45:55, particularly preferably from 52:48 to 48:52, and most preferably 50:50. In particular, in the case of using common salt as the solute, it is preferable that the ratio of the solute concentration in the flake ice to the solute concentration in the brine is in the above range.

The brine to serve as the raw material of the flake ice is not particularly limited, but in the case of using common salt as a solute, the brine is preferably seawater, water prepared by adding salt to seawater, or diluted water of seawater. This is because seawater, water prepared by adding salt to seawater, or diluted water of seawater is easily procured, and this makes it possible to cut down the procurement cost.

The ice slurry containing the flake ice may or may not further contain a solid having a higher thermal conductivity than the flake ice, but it is preferable to further contain the solid.

In the case where an object is to be cooled in a short time or a frozen object is to be defrosted by absorbing the cold energy therefrom, it is ordinarily possible to utilize a solid having a high thermal conductivity as a refrigerant or a heating medium. However, in the case of utilizing the solid having a high thermal conductivity as a refrigerant, the solid itself also loses cold energy in a short time and the temperature thereof is likely to increase, and therefore the solid is unsuitable for long-time cooling. Alternatively, in the case of utilizing the solid having a high thermal conductivity as a heating medium, the solid itself also obtains cold energy in a short time and the temperature thereof is likely to decrease, and therefore the solid is unsuitable to absorb the cold energy of the frozen object for a long time.

That is to say, it is better not to use a solid having a high thermal conductivity as a refrigerant or a heating medium for cooling an object for a long time or absorbing cold energy from a frozen object for a long time. However, a solid having a high thermal conductivity is unsuitable to cool an object in a short time or absorb cold energy from an object in a short time.

However, the flake ice has a high cooling capacity and also has a high capacity to absorb cold energy. For this reason, the flake ice is useful from the viewpoint that, while obtaining a short-time cooling capacity and a capacity to absorb cold energy in a short time by the solid having a high thermal conductivity, long-time cooling or absorption of cold energy from a frozen object for a long time is also possible.

Note that, examples of the solid having a higher thermal conductivity than the flake ice may include metals (aluminum, silver, copper, gold, duralumin, antimony, cadmium, zinc, tin, bismuth, tungsten, titanium, iron, lead, nickel, platinum, magnesium, molybdenum, zirconium, beryllium, indium, niobium, chromium, cobalt, iridium, and palladium), alloys (steel (carbon steel, chromium steel, nickel steel, chromium nickel steel, silicon steel, tungsten steel, manganese steel, and the like), nickel chrome alloy, aluminum bronze, gunmetal, brass, manganin, nickel silver, constantan, solder, alumel, chromel, monel metal, platinum iridium, and the like), silicon, carbon, ceramics (alumina ceramics, forsterite ceramics, steatite ceramics, and the like), marble, and bricks (magnesia brick, Corhart brick, and the like).

Moreover, as the solid having a higher thermal conductivity than the flake ice, a solid having a thermal conductivity of 2.3 W/mK or more (3 W/mK or more, 5 W/mK or more, 8 W/mK or more, or the like) is preferable, a solid having a thermal conductivity of 10 W/mK or more (20 W/mK or more, 30 W/mK or more, 40 W/mK or more, or the like) is more preferable, a solid having a thermal conductivity of 50 W/mK or more (60 W/mK or more, 75 W/mK or more, 90 W/mK or more, or the like) is still more preferable, a solid having a thermal conductivity of 100 W/mK or more (125 W/mK or more, 150 W/mK or more, 175 W/mK or more, or the like) is yet more preferable, a solid having a thermal conductivity of 200 W/mK or more (250 W/mK or more, 300 W/mK or more, 350 W/mK or more, or the like) is still yet more preferable, a solid having a thermal conductivity of 200 W/mK or more is still yet more preferable, and a solid having a thermal conductivity of 400 W/mK or more (410 W/mK or more or the like) is particularly preferable.

In a case where the ice slurry containing the flake ice contains a solid having a higher thermal conductivity than the flake ice, as described above, the ice slurry, even though containing a large amount of solid, is suitable for long-time cooling or absorbing cold energy from a frozen object for a long time. For example, the mass of the solid having a higher thermal conductivity than the flake ice/the mass of the flake ice contained in the ice slurry (or the total mass of the flake ice and the brine contained in the ice slurry) may be $1/100{,}000$ or more ($1/50{,}000$ or more, $1/10{,}000$ or more, $1/5{,}000$ or more, $1/1{,}000$ or more, $1/500$ or more, $1/100$ or more, $1/50$ or more, $1/10$ or more, $1/5$ or more, $1/4$ or more, $1/3$ or more, $1/2$ or more, and the like). Note that the above-described solid may have any shape, but preferably has a particulate shape. This is because such a solid has merits that the area to be brought into contact with the ice slurry is increased, processing thereof is easy, and so on.

In addition, the above-described solid may exist in a form of being contained inside the flake ice or may exist outside the flake ice; however, if the solid exists outside the flake ice, the solid is more likely to be brought into direct contact with an object, and thereby the cooling capacity or the capacity to absorb the cold energy from a frozen object is increased. From this, it is preferable that the above-described solid exists outside the ice. Moreover, in the case where the ice slurry containing the flake ice also contains the above-described solid, the solid may be mixed after the flake ice is produced by the flake ice production device to be described later, or the solid may be mixed into the brine serving as a raw material in advance to produce the flake ice.

[Flake Ice Production Device]

Though an aqueous solution in the state of being stored in a container is cooled from the outside, it is impossible to produce ice having the similar characteristics as the hybrid ice. This is considered to be caused by insufficient cooling speed.

However, according to a flake ice production device, which has been invented by the inventor of the present invention and has already been applied for patent (for example, Japanese Patent Application No. 2016-103637), it is possible to spray brine containing a solute in a mist form, bring the brine in the mist form into contact with a wall surface that has been cooled in advance to a temperature equal to or less than a solidifying point of the brine, to thereby freeze the brine, and cause the brine to directly adhere to the wall surface. This makes it possible to generate ice having high cooling capacity and satisfying the above conditions (a) and (b) (the hybrid ice).

Note that the flake ice production device that has been invented by the inventor of the present invention and has already been applied for patent will be described later with reference to the flake ice production device 200 in FIG. 1 and a flake ice production system 300 in FIG. 2.

(Ice Production Step)

The wall surface to be cooled in advance for freezing the adhered brine is not particularly limited. A wall surface capable of keeping a temperature equal to or less than the solidifying point of the brine may be sufficient. Examples of the wall surface may include the inner peripheral surface of a cylindrical structure such as the drum 21 in FIG. 1 to be described later (for example, the inner peripheral surface of the inner cylinder 32 in FIG. 1 to be described later).

The temperature of the wall surface is not particularly limited as long as it is kept at a temperature equal to or lower than the solidifying point of the brine, but it is preferable that the temperature is kept at a temperature lower by 1° C. or more (a temperature lower by 2° C. or more, a temperature lower by 3° C. or more, a temperature lower by 4° C. or more, a temperature lower by 5° C. or more, a temperature lower by 6° C. or more, a temperature lower by 7° C. or more, a temperature lower by 8° C. or more, a temperature lower by 9° C. or more, a temperature lower by 10° C. or more, a temperature lower by 11° C. or more, a temperature lower by 12° C. or more, a temperature lower by 13° C. or more, a temperature lower by 14° C. or more, a temperature lower by 15° C. or more, a temperature lower by 16° C. or more, a temperature lower by 17° C. or more, a temperature lower by 18° C. or more, a temperature lower by 19° C. or more, a temperature lower by 20° C. or more, a temperature lower by 21° C. or more, a temperature lower by 22° C. or more, a temperature lower by 23° C. or more, a temperature lower by 24° C. or more, a temperature lower by 25° C. or more, and the like) than the solidifying point of the brine from the viewpoint of capable of increase the purity of ice which satisfies the conditions (a) and (b) (the hybrid ice).

The method of spraying the brine toward the wall surface is not particularly limited, but the brine can be sprayed, for example, by a spraying unit, such as a spraying part 23 in FIG. 1 to be described later.

In this case, the pressure at the time of spraying may be, for example, 0.001 MPa or more (0.002 MPa or more, 0.005 MPa or more, 0.01 MPa or more, 0.05 MPa or more, 0.1 MPa or more, 0.2 MPa or more, and the like), or 1 MPa or less (0.8 MPa or less, 0.7 MPa or less, 0.6 MPa or less, 0.5 MPa or less, 0.3 MPa or less, 0.1 MPa or less, 0.05 MPa or less, 0.01 MPa or less, and the like). Moreover, the pressure at the time of spraying may be variably controlled.

(Collecting Step)

After the above-described ice production step, the hybrid ice generated on the wall surface is appropriately collected. The collecting method of the hybrid ice is not particularly limited, and for example, the hybrid ice generated on the wall surface may be peeled off using the blade 25 shown in FIG. 1 and the hybrid ice which has been peeled off to have flake forms and has fallen (in other words, the flake ice) may be collected. Moreover, the hybrid ice adhered to the wall surface may be peeled off by blowing air. This makes it possible to efficiently collect the hybrid ice as the flake ice without causing damage to the wall surface.

In addition, heat by ice production is generated when the brine is solidified to generate the hybrid ice. There is a possibility that actual melting completion temperature of the hybrid ice is affected as the hybrid ice has the heat by ice production. Incidentally, it is considered that the melting completion temperature of the hybrid ice is affected by the heat by ice production independently from the kind or concentration of the solute contained in the hybrid ice. For this reason, the temperature of the hybrid ice at the time when the hybrid ice is completely melted in actuality can be adjusted by adjusting the quantity of heat by ice production remaining on the hybrid ice. Note that the adjustment of heat by ice production remaining on the hybrid ice can be conducted by adjusting the holding time of the hybrid ice on the wall surface in the collecting step.

FIG. 1 is an image view including a partial, perspective cross-sectional view showing an outline of an existing flake ice production device 200.

As shown in FIG. 1, the flake ice production device 200 includes a drum 21, a rotary shaft 22, a spraying part 23, a peeling part 24, a blade 25, a flake ice discharge port 26, an upper bearing member 27, a spray control part 28, a heat insulating protective cover 29, a geared motor 30, a rotary joint 31, a refrigerant clearance 34, a bush 38, a refrigerant supply part 39 and a rotation control part 37.

The drum 21 is configured with an inner cylinder 32, an outer cylinder 33 surrounding the inner cylinder 32, and the refrigerant clearance 34 to be formed between the inner cylinder 32 and the outer cylinder 33. In addition, the outer peripheral surface of the drum 21 is covered with the cylindrical heat insulating protective cover 29.

An inner cylinder cooling refrigerant is supplied to the refrigerant clearance 34 from the refrigerant supply part 39 via a refrigerant tube 45. Consequently, the inner peripheral surface of the inner cylinder 32 is cooled.

The rotary shaft 22 is disposed on the central axis of the drum 21 and rotates around the material axis by taking the central axis as the axis and using the geared motor 30 installed above the upper bearing member 27 as a power source. Note that the rotational speed of the geared motor 30 is controlled by the rotation control part 37 to be described later.

The spraying part 23 is configured with plural pipes each having a spraying hole 23*a* at the tip end portion thereof for spraying the brine toward the wall surface of the inner cylinder 32 and rotates together with the rotary shaft 22. The brine sprayed through the spraying hole 23*a* adheres to the wall surface of the inner cylinder 32 cooled by the refrigerant, and is quickly frozen without being provided with time to be divided into the solute and the solvent.

The plural pipes constituting the spraying part 23 radially extend from the rotary shaft 22 in the radial direction of the drum 21.

The peeling part 24 is configured with plural arms each having the blade 25 provided at the tip end portion thereof, which peels off the hybrid ice generated on the inner peripheral surface of the inner cylinder 32. Note that the peeling part 24 extends in the radial direction of the drum 21 and rotates together with the rotary shaft 22.

The plural arms constituting the peeling part 24 are mounted to be symmetrical to the rotary shaft 22. Note that the peeling part 24 of the flake ice production device 200 shown in FIG. 1 is configured with the two arms; however, the number of arms is not particularly limited.

Moreover, the blade 25 mounted at the tip end of the arm is made of a member having a length substantially equal to the total length (total height) of the inner cylinder 32, and plural serrations 25*a* are formed on the end portion facing the inner peripheral surface of the inner cylinder 32.

The hybrid ice generated on the inner peripheral surface of the inner cylinder 32 is peeled off by the blade 25 to be obtained as flake ice. The flake ice falls through the flake ice discharge port 26. The flake ice fallen through the flake ice discharge port 26 is stored in a flake ice storage tank 44 (Refer to FIG. 2) disposed immediately below the flake ice production device 200.

In addition, the amount of flake ice to be produced may be adjusted by adjusting the amount of brine sprayed by the spraying part 23. In other words, the amount of flake ice to be produced can be increased by increasing the amount of brine sprayed by the spraying part 23. On the contrary, the amount of flake ice to be produced can be reduced by reducing the amount of brine sprayed by the spraying part 23.

The upper bearing member 27 has a shape formed as a pot is inverted and seals the upper surface of the drum 21. The bush 38 for supporting the rotary shaft 22 is fitted into the central portion of the upper bearing member 27. Note that the rotary shaft 22 is supported only by the upper bearing member 27, and the lower end portion of the rotary shaft 22 is not pivotally supported.

In other words, there is no obstacle below the drum 21 when the flake ice peeled off by the blade 25 falls, and thus the lower surface of the drum 21 serves as a flake ice discharge port 26 for discharging the flake ice.

The spray control part 28 controls the amount of brine sprayed from the spraying part 23 at the time of spraying of the brine by the spraying part 23. Note that the concrete method of controlling the amount of brine sprayed by the spraying part 23 is not particularly limited. For example, the number of pipes to spray the brine and the number of pipes not to spray the brine, of plural respective pipes constituting the spraying part 23, may be adjusted to thereby control the amount of brine to be sprayed. Moreover, for example, the amount of brine to be sprayed may be adjusted by increasing or decreasing the amount of brine to be fed to the plural pipes that spray the brine.

In addition, the spray control part 28 performs variable control of spraying pressure at the time of spraying of the brine by the spraying part 23. Availability of the variable control for spraying pressure of the brine enables control of volume of the brine adhering to the inner peripheral surface of the inner cylinder 32. That is to say, as compared to the case where the brine is sprayed in the mist form by high pressure, particles of the brine to adhere to the inner peripheral surface of the inner cylinder 32 are enlarged in the case where the brine is sprayed in a liquid form by low pressure. For this reason, the hybrid ice generated by spraying the brine in the liquid form by low pressure is less likely to be affected by the temperature of air inside the drum 21 that is higher than the temperature of the inner peripheral surface of the inner cylinder 32.

Consequently, the hybrid ice generated by spraying the brine in the liquid form by low pressure is less likely to be melted as compared to the case where the hybrid ice is generated by spraying the brine in the mist form by high pressure. Note that the concrete method of performing variable control of spraying pressure of the brine by the spraying part 23 is not particularly limited. For example, the variable control of the spraying pressure may be performed by adjusting the diameter of spraying ports (not shown) of the plural pipes that spray the brine.

The heat insulating protective cover 29 has a cylindrical shape and seals the side surface of the drum 21.

The refrigerant supply part 39 supplies the inner cylinder cooling refrigerant for cooling the inner peripheral surface of the inner cylinder 32 to the refrigerant clearance 34 via the refrigerant tube 45.

The refrigerant supplied to the refrigerant clearance 34 circulates between the refrigerant clearance 34 and the refrigerant supply part 39 via the refrigerant tube 45. Consequently, the inner cylinder cooling refrigerant supplied to the refrigerant clearance 34 can be kept with high cooling capacity.

[Flake Ice Production System]

Figure 2:
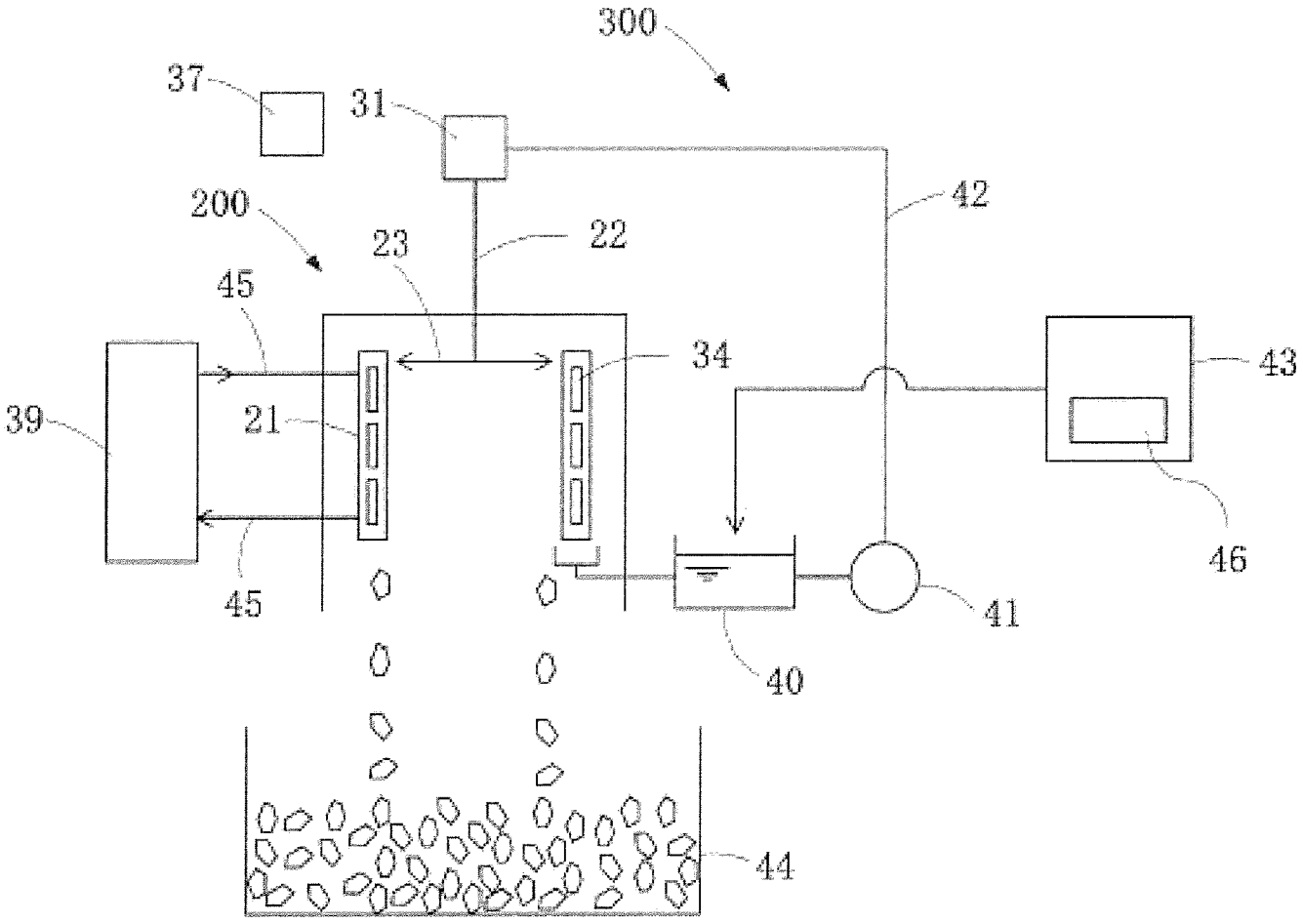
FIG. 2 is an image view showing an outline of the entire flake ice production system including the flake ice production device in FIG. 1.

FIG. 2 is an image view showing the outline of the entire flake ice production system 300 including the flake ice production device 200 in FIG. 1.

The flake ice production system 300 is configured to include: a brine storage tank 40, a pump 41, a brine tube 42, a brine tank 43, the flake ice storage tank 44, the refrigerant tube 45, a freezing point adjusting part 46 and a flake ice production device 200.

The brine storage tank 40 stores the brine to serve as a raw material of the hybrid ice. The brine stored in the brine storage tank 40 is supplied to the spraying part 23 via the brine tube 42 by operating the pump 41. The brine supplied to the spraying part 23 serves as a raw material to generate the hybrid ice.

The brine tank 43 supplies the brine to the brine storage tank 40 when the brine in the brine storage tank 40 has decreased.

Note that the brine which has not been frozen on the inner peripheral surface of the inner cylinder 32 but has flowed down is stored in the brine storage tank 40 and is again supplied to the spraying part 23 via the brine tube 42 by the pump 41 being operated.

The flake ice storage tank 44 is disposed immediately below the flake ice production device 200 and stores the flake ice which has fallen through the flake ice discharge port 26 of the flake ice production device 200.

The freezing point adjusting part 46 adjusts the freezing point of the brine to be supplied to the brine storage tank 40 from the brine tank 43. For example, in the case where the brine is salt water, the freezing point of the salt water varies depending on the concentration thereof. For this reason, the freezing point adjusting part 46 adjusts the concentration of the salt water stored in the brine storage tank 40.

Next, the operation of the flake ice production system 300 which includes the flake ice production device 200 and has the above-described configuration will be described on the assumption that the brine is the salt water.

First, the refrigerant supply part 39 supplies the refrigerant to the refrigerant clearance 34 and sets the temperature of the inner peripheral surface of the inner cylinder 32 to be lower than the freezing point of the salt water by about −10° C. This makes it possible to freeze the salt water adhered to the inner peripheral surface of the inner cylinder 32.

When the inner peripheral surface of the inner cylinder 32 is cooled, the pump 41 supplies the salt water, which is the brine, from the brine storage tank 40 to the spraying part 23 via the brine tube 42.

When the salt water is supplied to the spraying part 23, the spraying part 23 sprays the salt water toward the inner peripheral surface of the inner cylinder 32. The salt water sprayed through the spraying part 23 is instantly frozen when coming into contact with the inner peripheral surface of the inner cylinder 32 without being provided with time to be divided into the salt as the solute and the water as the solvent, to thereby generate the hybrid ice. Thus, the hybrid ice is generated.

The hybrid ice generated on the inner peripheral surface of the inner cylinder 32 is peeled off by the peeling part 24 which moves down in the inner cylinder 32. The hybrid ice peeled off by the peeling part 24 falls as the flake ice through the flake ice discharge port 26. The flake ice fallen through the flake ice discharge port 26 is stored in the flake ice storage tank 44 disposed immediately below the flake ice production device 200.

In addition, as described above, the salt water which has not been frozen and converted to the hybrid ice but has flowed down the inner peripheral surface of the inner cylinder 32 is stored in the brine storage tank 40 and is again supplied to the spraying part 23 via the brine tube 42 by the pump 41 being operated. Note that the brine tank 43 supplies the salt water stored in the brine tank 43 itself to the brine storage tank 40 in the case where the salt water in the brine storage tank 40 has decreased.

As described above, according to the existing flake ice production device 200 and the flake ice production system 300 including the device shown in FIGS. 1 and 2, respectively, it becomes possible to produce the flake ice in which the solute concentration is substantially uniform with ease.

[State Change Control Device]

A state change control device 1, which is an embodiment according to the present invention, brings the ice slurry containing the flake ice produced by the flake ice production device 200 in FIG. 1 and the flake ice production system 300 in FIG. 2 into contact with an object, to thereby efficiently cause state change to the object.

Hereinafter, the state change control device 1, which is an embodiment according to the present invention, will be described based on the drawings.

(Cooling Function)

Figure 3:
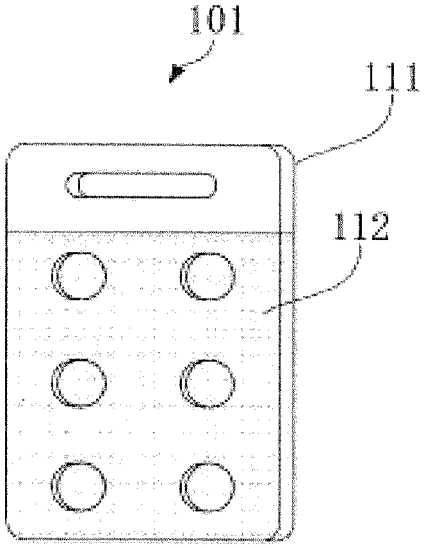
FIG. 3 is a diagram showing a cold storage agent, which is an example of an object to be cooled by a cooling function of a state change control device according to the present invention.

FIG. 3 is a diagram showing a cold storage agent 101, which is an example of a cooling object to be cooled by a cooling function of the state change control device 1.

As shown in FIG. 3, the cold storage agent 101 is an ordinary cold storage agent that stores a refrigerant 112 in a liquid form and seals the refrigerant inside a main body part 111. In general, the entire cold storage agent 101 including the main body part 111 is cooled to freeze the refrigerant 112, to be used for keeping fresh marine products and the like cool.

Note that, in the present specification, "to freeze a cold storage agent" and "to freeze a refrigerant sealed in a cold storage agent" have the same meaning.

As described above, the cold storage agent 101 is often used in a freezer container that is not provided with a freezing machine, and the air blast (air refrigeration) method is used for freezing the cold storage agent 101.

Consequently, large amounts of energy and time have been spent for freezing the cold storage agent 101.

Therefore, the inventor of the present invention has invented the cooling method capable of efficiently cooling and freezing the cold storage agent 101 by bringing the ice slurry containing the above-described hybrid ice into contact with the cold storage agent 101.

Figure 4A:
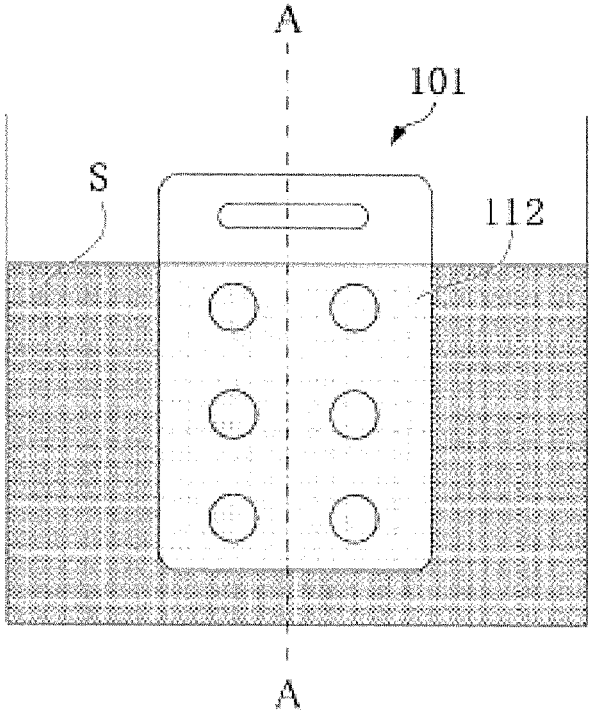
FIG. 4A is a diagram showing a state in which the cold storage agent is immersed in stored ice slurry.

FIG. 4A is a diagram showing a state in which the cold storage agent 101 is immersed in the stored ice slurry S.

As shown in FIG. 4A, when the cold storage agent 101 is immersed in the stored ice slurry S, the cold storage agent 101 is rapidly cooled, and therefore the refrigerant 112 inside the cold storage agent 101 is quickly frozen.

Figure 5:
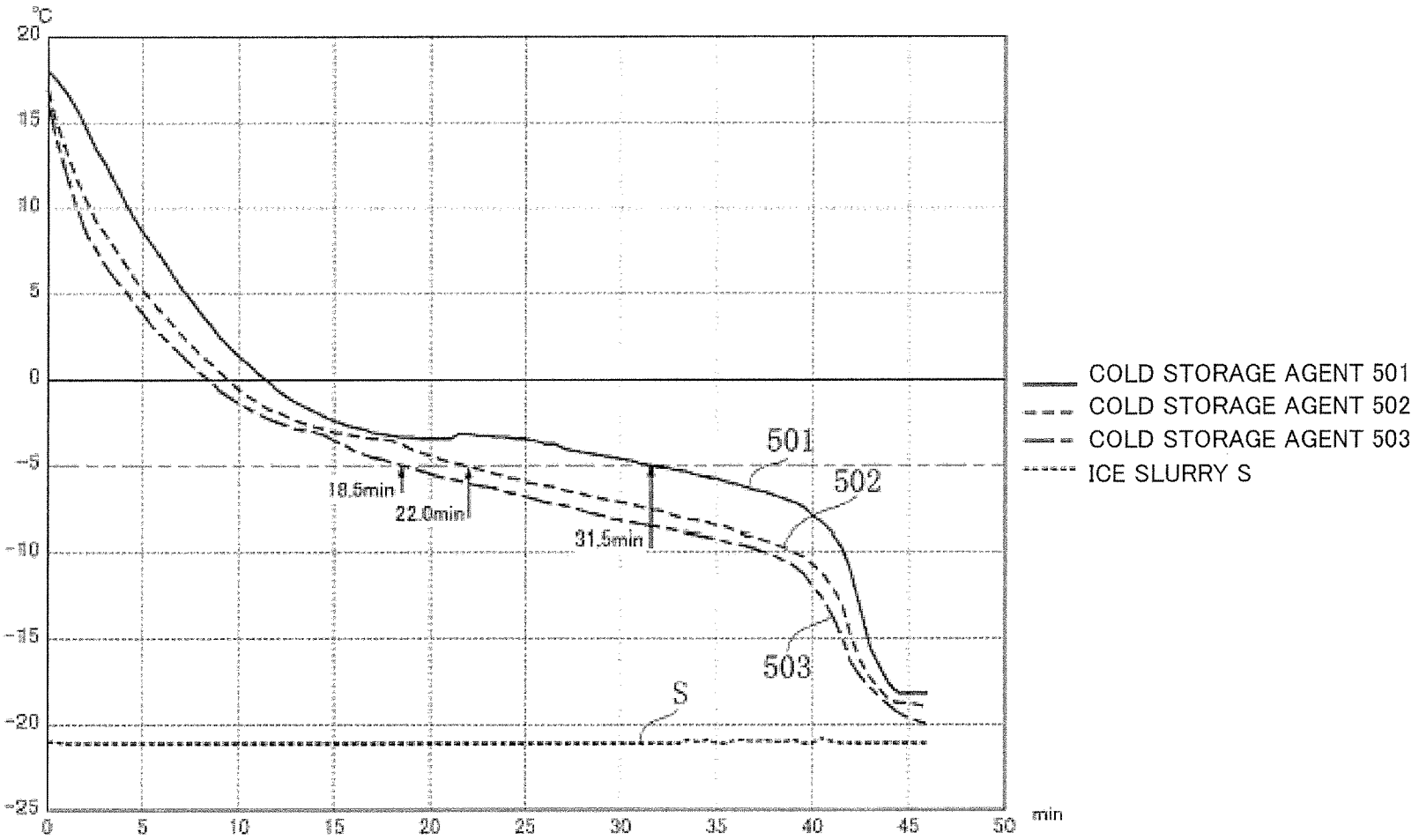
FIG. 5 is a graph showing temperature changes of three types of cold storage agents and ice slurry in an experiment in which the three types of cold storage agents are immersed in the ice slurry to be frozen.

FIG. 5 is a graph showing temperature changes of three types of cold storage agents (the cold storage agent 501 to the cold storage agent 503) and the ice slurry S in an experiment in which the three types of cold storage agents (the cold storage agent 501 to the cold storage agent 503) are immersed in the ice slurry S to be frozen. Note that each of the cold storage agents 501 to 503 is of a type to be frozen at −5° C., and the cold storage agents are manufactured by respective different manufacturers.

Each of the cold storage agents 501 to 503 serving as objects has the solidifying point of −5° C.; therefore, the temperature of the cold storage agent is decreased by being cooled and the cold storage agent is frozen when the temperature reaches −5° C.

As shown in FIG. 5, immersing each of the cold storage agents 501 to 503 at ordinary temperature (from about 16° C. to about 18° C.) in the ice slurry S and cooling thereof caused rapid temperature drop to be started, and 18.5 minutes after the start of cooling, the temperature of the cold storage agent 503 reached −5° C. and the cold storage agent 503 was frozen. Next, 22 minutes after the start of cooling, the temperature of the cold storage agent 502 reached −5° C. and the cold storage agent 502 was frozen. Then, 31. 5 minutes after the start of cooling, the temperature of the cold storage agent 501 reached −5° C. and the cold storage agent 501 was frozen.

In addition, the temperature of the cold storage agents 501 to 503 continued to decrease after being frozen, further started to rapidly decrease about 40 minutes after the start of cooling, and reached the temperature (from about −18° C. to about −20° C.) near the temperature of the ice slurry S, −21.3° C., about 45 minutes after the start of cooling.

Note that, as shown in FIG. 5, the temperature of the ice slurry S of the state change control device 1 was always maintained at about −21.3° C.

In this manner, the freezing process of the cold storage agent that required about eight hours by the conventional air blast (air refrigeration) can be performed in several tens of minutes by use of the ice slurry S. In other words, it becomes possible to freeze the cold storage agent efficiently at low cost and in a short time, which could not be achieved by the freezing technique based on the conventional air blast (air refrigeration) method.

However, in the case where the cold storage agent 101 is immersed in the stored ice slurry S, part of the ice slurry that is in contact with the surface portion of the cold storage agent 101 is melted and changed into the brine by the temperature difference between the cold storage agent 101 at the ordinary temperature and the ice slurry. For example, in the case where common salt is adopted as the solute of the ice slurry S, the cold storage agent 101 at the ordinary temperature is immersed in the ice slurry at the temperature of about −21.3° C.; accordingly, part of the ice slurry that is in contact with the surface portion of the cold storage agent 101 is melted and changed into the brine by the temperature difference.

Here, while the thermal conductivity of the ice slurry containing the flake ice containing common salt as a solute is about 2.2 W/mK, the thermal conductivity of the brine (salt water) similarly containing common salt as a solute is about 0.58 W/mK. That is, the ice slurry has characteristics that the thermal conductivity thereof is rapidly decreased when the ice slurry is melted and changed into the brine.

In other words, a membrane of the brine is formed on the surface portion of the cold storage agent 101 by the temperature difference between the ice slurry S and the cold storage agent 101 at the ordinary temperature, and the membrane prevents the cold storage agent 101 from being cooled by the ice slurry S.

Figure 4B:
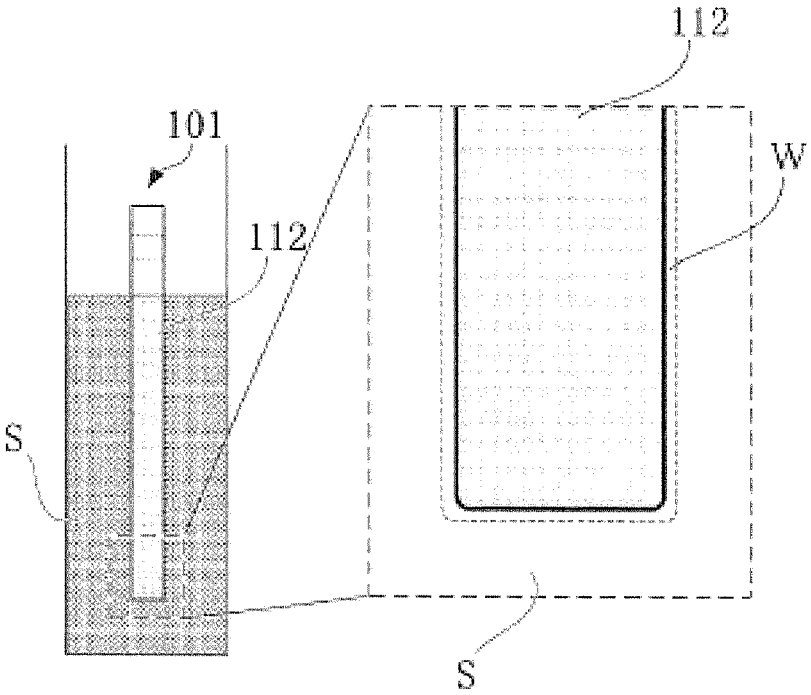
FIG. 4B is a diagram showing an A-A cross section in FIG. 4A.

FIG. 4B is a diagram showing an A-A cross section in FIG. 4A. Within a broken line at the right side of FIG. 4B, a diagram enlarging a bottom portion of the cold storage agent 101 is shown. As shown in the enlarged view in the broken line, a brine membrane W is formed on the surface portion of the cold storage agent 101. The brine membrane W prevents cooling of the cold storage agent 101 by the ice slurry S.

Like this, in the case where the cold storage agent 101 at the ordinary temperature is immersed in the stored ice slurry S, there is a problem that efficient cooling is prevented by the brine membrane formed on the surface portion of the cold storage agent 101 due to the temperature difference.

Therefore, the inventor of the present invention has invented the state change control device 1 capable of solving the problem and efficiently cooling an object to freeze thereof.

Figure 6A:
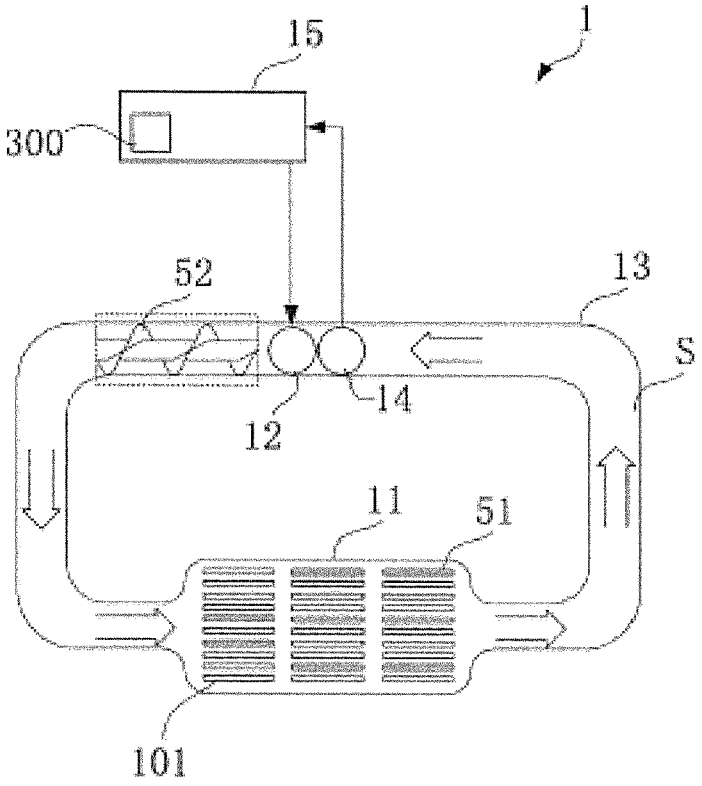
FIG. 6A is a plan image view including an example of a configuration of exterior appearance in a case where the state change control device, which is an embodiment of the present invention, exerts the cooling function.

FIG. 6A is a plan image view including an example of a configuration of exterior appearance in a case where the state change control device 1, which is an embodiment of the present invention, exerts the cooling function.

Figure 6B:
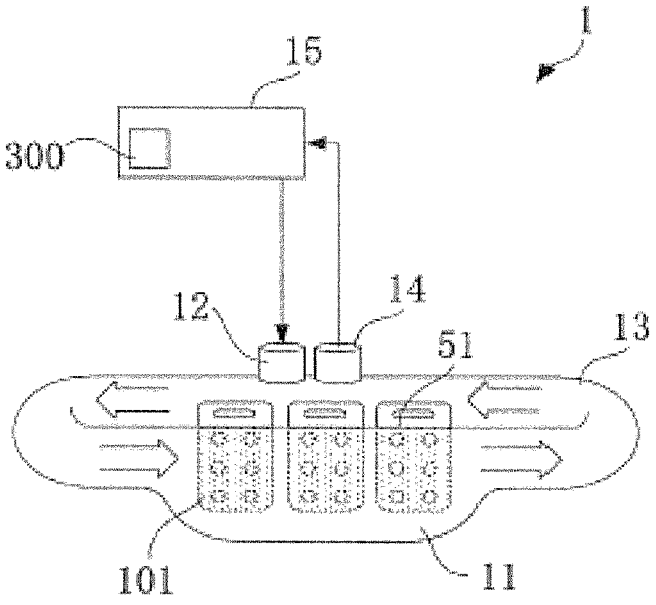
FIG. 6B is a front image view including an example of a configuration of exterior appearance in the case where the state change control device, which is an embodiment of the present invention, exerts the cooling function.

FIG. 6B is a front image view including an example of a configuration of exterior appearance in the case where the state change control device 1, which is an embodiment of the present invention, exerts the cooling function.

As shown in FIGS. 6A and 6B, the state change control device 1 includes: an ice slurry contact part 11; an ice slurry supply part 12; an ice slurry circulation part 13; an extraction part 14; and an ice slurry production part 15.

The ice slurry contact part 11 brings the cold storage agent 101 and the ice slurry S into contact with each other at a predetermined relative speed to cool the cold storage agent 101.

Specifically, the ice slurry contact part 11 brings the cold storage agent 101 fastened to an object fastening part 51 for fastening the cold storage agent 101 into contact with the ice slurry S flowing inside the ice slurry contact part 11 at the predetermined relative speed, to thereby cool the cold storage agent 101.

In other words, the ice slurry S in the ice slurry contact part 11 is not stored like the ice slurry S in FIG. 4 but is caused to flow at the predetermined relative speed every moment by the ice slurry circulation part 13 to be described later. Consequently, without providing a moment to form the brine membrane on the surface portion of the cold storage agent 101, a state in which the flowing ice slurry S is in contact with the cold storage agent 101 every moment can be maintained. Note that the specific value of the predetermined relative speed is not particularly limited, and the speed can be arbitrarily adjusted according to details of the state change or the object.

In addition, from a viewpoint of forming no brine membrane on the surface portion of the cold storage agent 101, not only the ice slurry S but also the cold storage agent 101 itself may be moved in the ice slurry S. For example, the object fastening part 51 may be provided with a function of vibrating or oscillating the fastened cold storage agent 101. This makes it possible not to form the brine membrane on the surface portion of the cold storage agent 101.

In this manner, according to the state change control device 1, the freezing process of the cold storage agent 101 that required about eight hours by the conventional air blast (air refrigeration) method can be performed in about several tens of minutes. In other words, it is possible to achieve freezing of the cold storage agent efficiently at low cost and in a short time, which could not be achieved by the freezing technique based on the conventional air blast (air refrigeration) method.

The ice slurry supply part 12 supplies the ice slurry S to the ice slurry contact part 11.

Specifically, the ice slurry supply part 12 supplies the ice slurry S produced by the ice slurry production part 15, which will be described later, to the ice slurry contact part 11 via the ice slurry circulation part 13, which will be described later.

In addition, when the ice slurry S is supplied, the ice slurry supply part 12 adjusts the amounts of ice slurry S that actually flows through the inside of the ice slurry contact part 11 and the ice slurry circulation part 13 to be appropriate.

This makes it possible, in the ice slurry contact part 11, to prevent the cases in which the ice slurry contact part 11 is overflowed with the ice slurry S due to excessive supply of the ice slurry S or the ice slurry S is not brought into contact with the cold storage agent 101 in the ice slurry contact part 11 due to short supply of the ice slurry S.

The ice slurry circulation part 13 feeds the ice slurry S to the ice slurry contact part 11.

Specifically, the ice slurry circulation part 13 rotates a screw conveyor 52 to feed the ice slurry S supplied by the ice slurry supply part 12 to the ice slurry contact part 11 or to cause the fed ice slurry S to be discharged from the ice slurry contact part 11. Consequently, the ice slurry S fed to the ice slurry contact part 11 passes through the ice slurry contact part 11 while being in contact with or not being in contact with the cold storage agent 101 in the ice slurry contact part 11 and is discharged therefrom. Then, the ice slurry circulation part 13 rotates the screw conveyor 52 to return the ice slurry S discharged from the ice slurry contact part 11 to the ice slurry contact part 11.

As described above, the ice slurry circulation part 13 circulates the ice slurry S in the state change control device 1 by rotating the screw conveyor 52.

Here, a portion of FIG. 6A enclosed by a broken line shows a state inside the ice slurry circulation part 13. Note that the portion enclosed by the broken line is merely a part of the ice slurry circulation part 13 in FIG. 6A; however, it is assumed that the screw conveyor 52 is also disposed in each the other portions of the ice slurry circulation part 13 similar to the portion enclosed by the broken line.

The extraction part 14 extracts the brine contained in the ice slurry S discharged from the ice slurry contact part 11 by the ice slurry circulation part 13 and provides the brine to the ice slurry production part 15.

Here, the reason why the brine contained in the ice slurry S discharged from the ice slurry contact part 11 is extracted by the extraction part 14 will be described.

First, the mixing ratio of the flake ice and the brine contained in the ice slurry S is not particularly limited. The optimum mixing ratio in accordance with the application purpose may be adopted. However, repetition of the cooling and freezing process of the cold storage agent 101 melts the portion of the flake ice (the solid portion) of the ice slurry S. Consequently, in the mixing ratio of the flake ice and the brine in the ice slurry S circulating in the state change control device 1, the proportion of the flake ice portion (the solid portion) decreases and the proportion of the brine portion (the liquid portion) increases as time passes.

For this reason, the extraction part 14 extracts the brine contained in the ice slurry S discharged from the ice slurry contact part 11 to maintain the optimum mixing ratio of the flake ice and the brine in the circulating ice slurry S.

In addition, the extraction part 14 provides the extracted brine to the ice slurry production part 15, which will be described later, as a raw material used for producing the ice slurry S. The brine provided to the ice slurry production part 15 is used as the brine to be contained in the ice slurry S produced by the ice slurry production part 15 or used as a raw material for producing the flake ice to be contained in the ice slurry S by the flake ice production device 200.

This makes it possible to keep the mixing ratio of the flake ice and the brine contained in the circulating ice slurry constant, and to efficiently reuse the brine obtained by melting the ice slurry S.

Note that the concrete method of extracting the brine contained in the ice slurry S discharged from the ice slurry contact part 11 by the extraction part 14 is not particularly limited. For example, a method of separating the brine from the ice slurry by a separator using specific gravity may be used.

The ice slurry production part 15 mixes the flake ice produced by the flake ice production system 300 and the brine at a predetermined ratio, to thereby produce the ice slurry S.

As described above, the mixing ratio of the flake ice and the brine in producing the ice slurry S is not particularly limited. The optimum mixing ratio may be adopted in accordance with the application purpose of the ice slurry S.

Moreover, the ice slurry production part 15 can variably set the void ratio of the ice slurry S in producing the ice slurry S.

Next, a flow of the cooling process performed by the state change control device 1 having the above-described configuration will be described with reference to FIG. 7.

Figure 7:
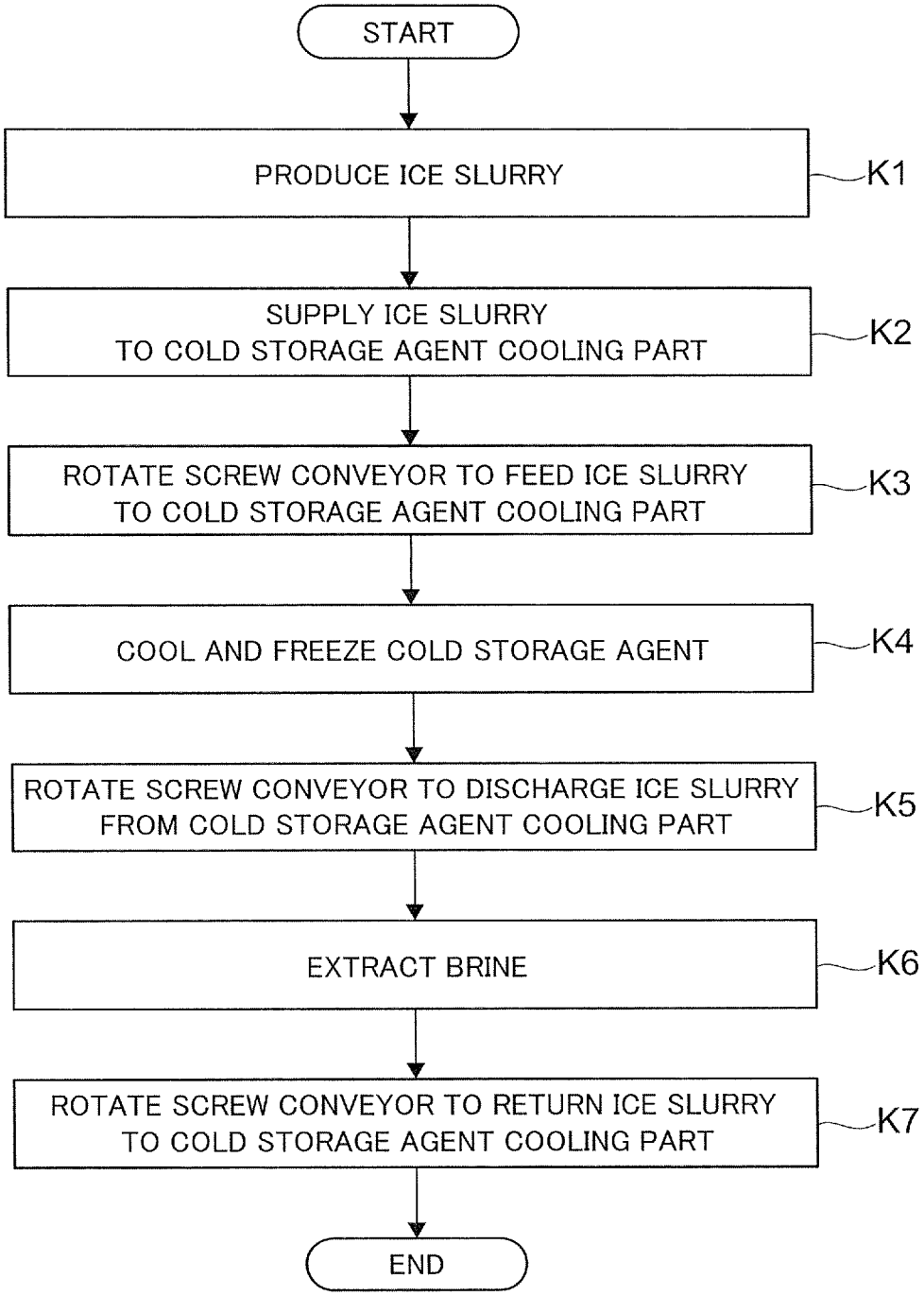
FIG. 7 is a flowchart illustrating a flow of a cooling process performed by the state change control device having configurations in FIGS. 6A and 6B.

FIG. 7 is a flowchart illustrating the flow of the cooling process performed by the state change control device 1 having the above-described configuration.

As shown in FIG. 7, the state change control device 1 performs a series of steps as follows to cool and freeze the cold storage agent 101 fastened to the object fastening part 51.

In step K1, the ice slurry production part 15 mixes the flake ice produced by the flake ice production device 200 and the brine used as the raw material of the flake ice at a predetermined proportion, to thereby produce the ice slurry S.

In step K2, the ice slurry supply part 12 supplies the ice slurry S produced in the step K1 to the ice slurry contact part 11 via the ice slurry circulation part 13.

In step K3, the ice slurry circulation part 13 rotates the screw conveyor 52 to feed the ice slurry S supplied from the ice slurry supply part 12 to the ice slurry contact part 11.

In step K4, the ice slurry contact part 11 brings the cold storage agent 101 fastened to an object fastening part 51 for fastening the cold storage agent 101 into contact with the ice slurry S flowing inside the ice slurry contact part 11 at the predetermined relative speed, to thereby cool the cold storage agent 101.

In step K5, the ice slurry circulation part 13 rotates the screw conveyor 52 to discharge the ice slurry S from the ice slurry contact part 11, the ice slurry S having been passed through while being in contact with or not being in contact with the cold storage agent 101 in the ice slurry contact part 11.

In step K6, the extraction part 14 extracts the brine contained in the ice slurry S discharged from the ice slurry contact part 11 in the step K5 and provides the brine to the ice slurry production part 15 as the raw material used for producing the ice slurry S.

In step K7, the ice slurry circulation part 13 rotates the screw conveyor 52 to return the ice slurry S discharged from the ice slurry contact part 11 in the step K5 to the ice slurry contact part 11. Note that a part of the brine in the ice slurry S discharged from the ice slurry contact part 11 is extracted by the extraction part 14 in the step K6. Thus, the process is finished.

Through the above-described steps, the state change control device 1 can perform the freezing process of the cold storage agent that required about eight hours by the conventional air blast (air refrigeration) method in about several tens of minutes. In other words, it is possible to achieve freezing of the cold storage agent efficiently at low cost and in a short time, which could not be achieved by the freezing technique based on the conventional air blast (air refrigeration) method.

(Defrosting Function)

Figure 8:
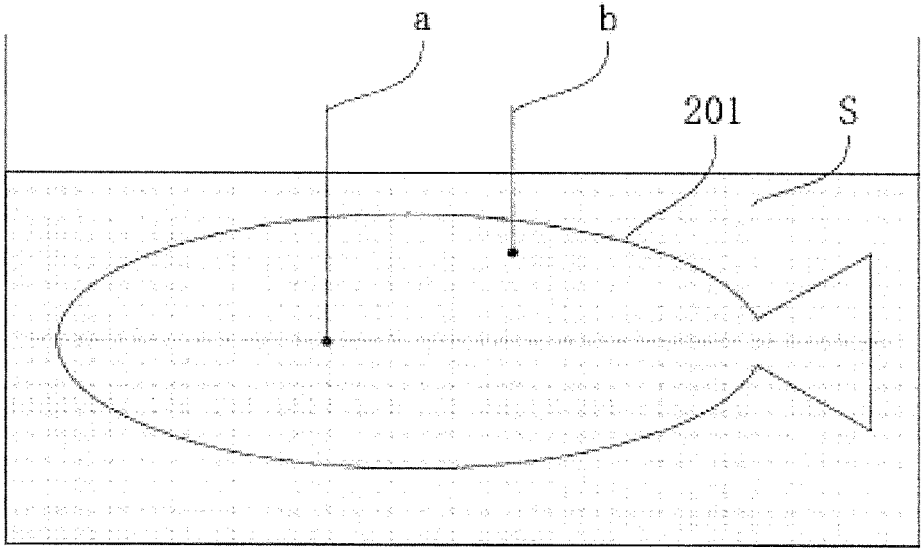
FIG. 8 is a diagram showing a fish frozen at −21° C. as an example of an object to be defrosted by the stored ice slurry.

FIG. 8 is a diagram showing a fish 201 frozen at −21° C. as an example of a case where an object is to be defrosted by the stored ice slurry S.

As shown in FIG. 8, the fish 201 frozen at −21° C. can be defrosted by being immersed in the stored ice slurry S.

Here, for measuring temperature changes in some positions in the body of the fish 201 frozen at −21° C., thermometers a and b are disposed at two points in the body of the fish 201 to perform an experiment. Specifically, the thermometer a is disposed at the position of 8 cm from the surface of the fish body of the fish 201 and the thermometer b is disposed at the position of 2 cm from the surface of the fish body of the fish 201. Incidentally, the result of the experiment will be described later with reference to FIG. 12.

Figure 9A:
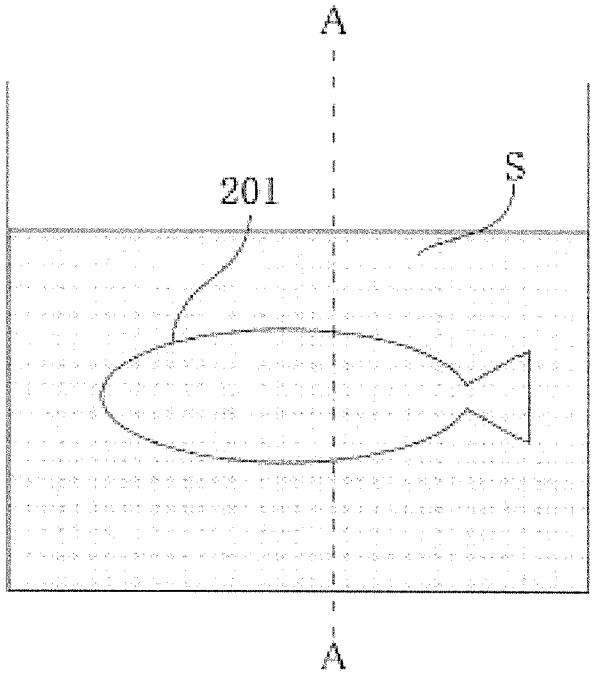
FIG. 9A is a diagram showing a state in which the fish frozen at −21° C. is immersed in the stored ice slurry.

FIG. 9A is a diagram showing a state in which the fish 201 frozen at −21° C. is immersed in the stored ice slurry S.

As shown in FIG. 9A, immersion of the fish 201 frozen at −21° C. in the stored ice slurry S defrosts the fish 201 rapidly because the fish 201 rapidly takes the cold energy. Here, the ice slurry used in the state change control device 1 has the temperature of −1° C. and the salt concentration of 1%. This is because, since the ice slurry with the temperature of −1° C. and the salt concentration of 1% is isotonic with the fish 201, meat or the like as a frozen object, the ice slurry does not destroy cells of the fish 201, meat or the like. The cells are not destroyed; therefore, the fish 201, meat or the like can be refrigerated even after being completely defrosted.

However, in the case where the fish 201 is immersed in the stored ice slurry S, the brine contained in the ice slurry S brought into contact with the surface of the frozen fish 201 is cooled and solidified to generate ice (frost) to be attached to the surface. However, the ice (frost) attached to the surface of the fish 201 is generated from the portion of water (fresh water) that does not contain any solute (for example, common salt). This is based on characteristics that an aqueous solution in which a solute, such as common salt, is dissolved is rarely frozen uniformly as is, and the portion of the fresh water that does not contain the solute (for example, the common salt) is frozen at first.

Therefore, even though the fish 201 is immersed in the stored ice slurry S, the portion of the fresh water of the ice slurry S is frozen first to generate ice (frost) and is attached to the surface of the fish 201. At this time, the ice (frost) attached to the surface of the fish 201 is ice solidified from fresh water and the ice constitutes a membrane of ice (frost) having a temperature lower than that of the ice slurry S (−1° C.), to thereby wrap the fish 201.

Due to the membrane of the ice (frost), the fish 201 and the ice slurry S cannot directly contact with each other, and thereby it becomes impossible to efficiently defrost the fish by the temperature of the ice slurry S (−1° C.).

In other words, even though a sufficient temperature difference exists between the ice slurry S at the temperature of −1° C. and the fish 201 at the temperature of −21° C., the membrane of ice, which has a temperature lower than −1° C. of the solidified fresh water, is formed on the surface portion of the fish 201. The membrane of the ice prevents absorption of the cold energy from the fish 201 by the ice slurry S.

Figure 9B:
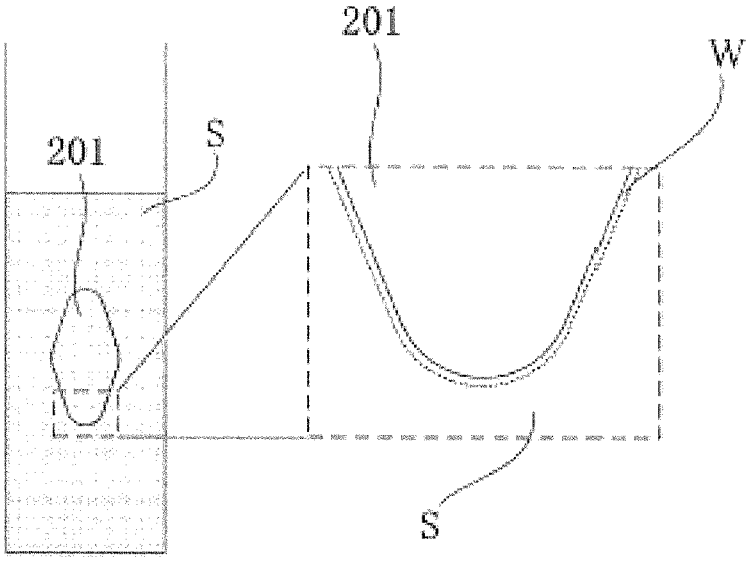
FIG. 9B is a diagram showing A-A in FIG. 9A.

FIG. 9B is a diagram showing an A-A cross section in FIG. 9A. Within a broken line at the right side of FIG. 9B, a diagram enlarging a bottom portion of the fish 201 is shown. As shown in the enlarged view in the broken line, an ice membrane W having a temperature lower than −1° C. of the solidified fresh water is formed on the surface portion of the fish 201. The ice membrane W prevents the ice slurry S (−1° C.) from absorbing the cold energy from the fish 201. In other words, in the case where the fish 201 at the temperature of −21° C. is immersed in the stored ice slurry S at the temperature of −1° C., a problem occurs that efficient cooling is prevented by the ice membrane formed on the surface portion of the fish 201 even though a sufficient temperature difference exists between the ice slurry S and the fish 201.

Therefore, the inventor of the present invention has invented the state change control device 1 capable of solving the problem and efficiently defrosting a frozen object.

Figure 10A:
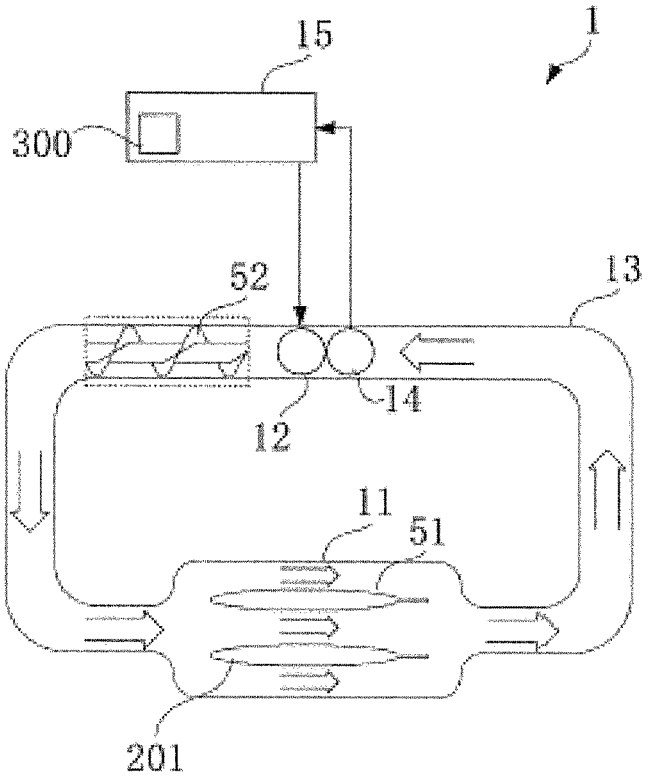
FIG. 10A is a plan image view including an example of a configuration of exterior appearance in a case where the state change control device, which is an embodiment of the present invention, exerts a defrosting function.

FIG. 10A is a plan image view including an example of a configuration of exterior appearance in a case where the state change control device 1, which is an embodiment of the present invention, exerts a defrosting function.

Figure 10B:
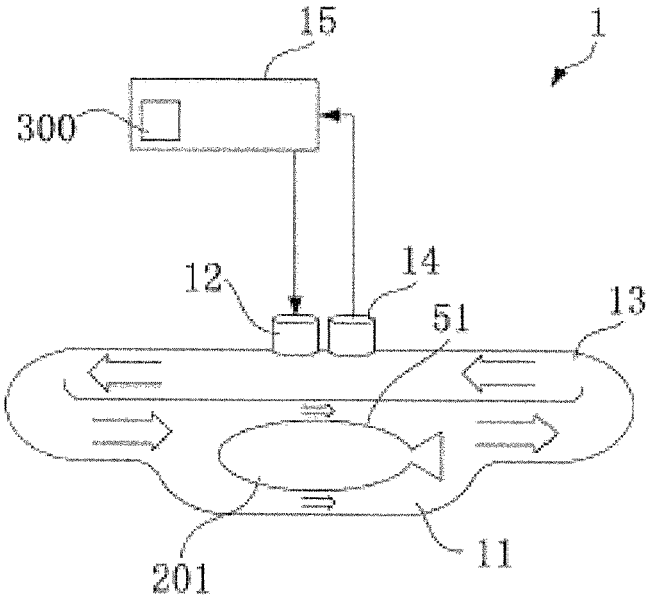
FIG. 10B is a front image view including an example of a configuration of exterior appearance in the case where the state change control device, which is an embodiment of the present invention, exerts the defrosting function.

FIG. 10B is a front image view including an example of the configuration of exterior appearance in the case where the state change control device 1, which is the embodiment of the present invention, exerts the defrosting function.

As shown in FIGS. 10A and 10B, the state change control device 1 includes: the ice slurry contact part 11; the ice slurry supply part 12; the ice slurry circulation part 13; the extraction part 14; and the ice slurry production part 15.

The ice slurry contact part 11 brings a fish 201 frozen at −21° C. and the ice slurry S into contact with each other at a predetermined relative speed, and thereby causes the ice slurry S to absorb the cold energy from the fish 201.

Specifically, the ice slurry contact part 11 brings the fish 201 fastened to the object fastening part 51 for fastening the fish 201 into contact with the ice slurry S flowing inside the ice slurry contact part 11 at the predetermined relative speed, to thereby absorb the cold energy from the fish 201 and defrost thereof.

In other words, the ice slurry S in the ice slurry contact part 11 is not stored like the ice slurry S in FIG. 8 but is caused to flow at the predetermined relative speed every moment by the ice slurry circulation part 13 to be described later. Consequently, without providing a moment to form the ice membrane having the temperature lower than −1° C. of fresh water on the surface portion of the fish 201, a state in which the flowing ice slurry S at the temperature of −1° C. is in contact with the fish 201 every moment can be maintained.

In addition, from a viewpoint of forming no ice membrane having the temperature lower than −1° C. of fresh water on the surface portion of the fish 201, not only the ice slurry S but also the fish 201 itself may be moved in the ice slurry S. For example, the object fastening part 51 may be provided with a function of vibrating or oscillating the fastened fish 201. This makes it possible not to form the ice membrane having the temperature lower than −1° C. of fresh water on the surface portion of the fish 201.

As described above, according to the state change control device 1, it is possible to achieve defrosting of a frozen object efficiently at low cost and in a short time, which could not be achieved by conventional defrosting techniques.

The ice slurry supply part 12 supplies the ice slurry S to the ice slurry contact part 11.

Specifically, the ice slurry supply part 12 supplies the ice slurry S produced by the ice slurry production part 15, which will be described later, to the ice slurry contact part 11 via the ice slurry circulation part 13, which will be described later.

In addition, when the ice slurry S is to be supplied, the ice slurry supply part 12 adjusts the amounts of ice slurry S that actually flows through the inside of the ice slurry contact part 11 and the ice slurry circulation part 13 to be appropriate.

This makes it possible, in the ice slurry contact part 11, to prevent the cases in which the ice slurry contact part 11 is overflowed with the ice slurry S due to excessive supply of the ice slurry S or the ice slurry S is not brought into contact with the fish 201 in the ice slurry contact part 11 due to short supply of the ice slurry S.

The ice slurry circulation part 13 feeds the ice slurry S to the ice slurry contact part 11.

Specifically, the ice slurry circulation part 13 rotates the screw conveyor 52 to feed the ice slurry S supplied by the ice slurry supply part 12 to the ice slurry contact part 11 or to cause the fed ice slurry S to be discharged from the ice slurry contact part 11. Consequently, the ice slurry S fed to the ice slurry contact part 11 passes through the ice slurry contact part 11 while being in contact with or not being in contact with the fish 201 in the ice slurry contact part 11 and is discharged therefrom. Then, the ice slurry circulation part 13 rotates the screw conveyor 52 to return the ice slurry S discharged from the ice slurry contact part 11 to the ice slurry contact part 11.

As described above, the ice slurry circulation part 13 circulates the ice slurry S in the state change control device 1 by rotating the screw conveyor 52.

Here, a portion of FIG. 10A enclosed by a broken line shows a state inside the ice slurry circulation part 13. Note that the portion enclosed by the broken line is merely a part of the ice slurry circulation part 13 in FIG. 10A; however, it is assumed that the screw conveyor 52 is also disposed in each the other portions of the ice slurry circulation part 13 similar to the portion enclosed by the broken line.

The extraction part 14 extracts the flake ice contained in the ice slurry S discharged from the ice slurry contact part 11 by the ice slurry circulation part 13 and provides the flake ice to the ice slurry production part 15.

Here, the reason why the flake ice contained in the ice slurry S discharged from the ice slurry contact part 11 is extracted by the extraction part 14 will be described.

First, the mixing ratio of the flake ice and the brine contained in the ice slurry S is not particularly limited. The optimum mixing ratio in accordance with the application purpose may be adopted. However, when the defrosting process of the fish 201 is repeated, the portion of the brine (the liquid portion) of the ice slurry S absorbs the cold energy from the object to solidify itself. Consequently, in the mixing ratio of the flake ice and the brine in the ice slurry S circulating in the state change control device 1, the proportion of the flake ice portion (the solid portion) increases and the proportion of the brine portion (the liquid portion) decreases as time passes.

For this reason, the extraction part 14 extracts the flake ice contained in the ice slurry S discharged from the ice slurry contact part 11 to maintain the optimum mixing ratio of the flake ice and the brine in the circulating ice slurry S.

In addition, the extraction part 14 provides the extracted flake ice to the ice slurry production part 15, which will be described later, as a raw material used for producing the ice slurry S. The flake ice provided to the ice slurry production part 15 is used as the flake ice to be contained in the ice slurry S produced by the ice slurry production part 15.

This makes it possible to keep the mixing ratio of the flake ice and the brine contained in the circulating ice slurry constant, and to efficiently reuse the flake ice obtained by solidification of part of the ice slurry S.

Note that the concrete method of extracting the flake ice contained in the ice slurry S discharged from the ice slurry contact part 11 by the extraction part 14 is not particularly limited. For example, a method of separating the flake ice from the ice slurry by a separator using specific gravity may be used.

The ice slurry production part 15 mixes the flake ice produced by the flake ice production system 300 and the brine at a predetermined ratio, to thereby produce the ice slurry S.

As described above, the mixing ratio of the flake ice and the brine in producing the ice slurry S is not particularly limited. The optimum mixing ratio may be adopted in accordance with the application purpose of the ice slurry S.

Moreover, the ice slurry production part 15 can variably set the void ratio of the ice slurry S in producing the ice slurry S.

Next, a flow of a process performed by the state change control device 1 having the above-described configuration will be described with reference to FIG. 11.

Figure 11:
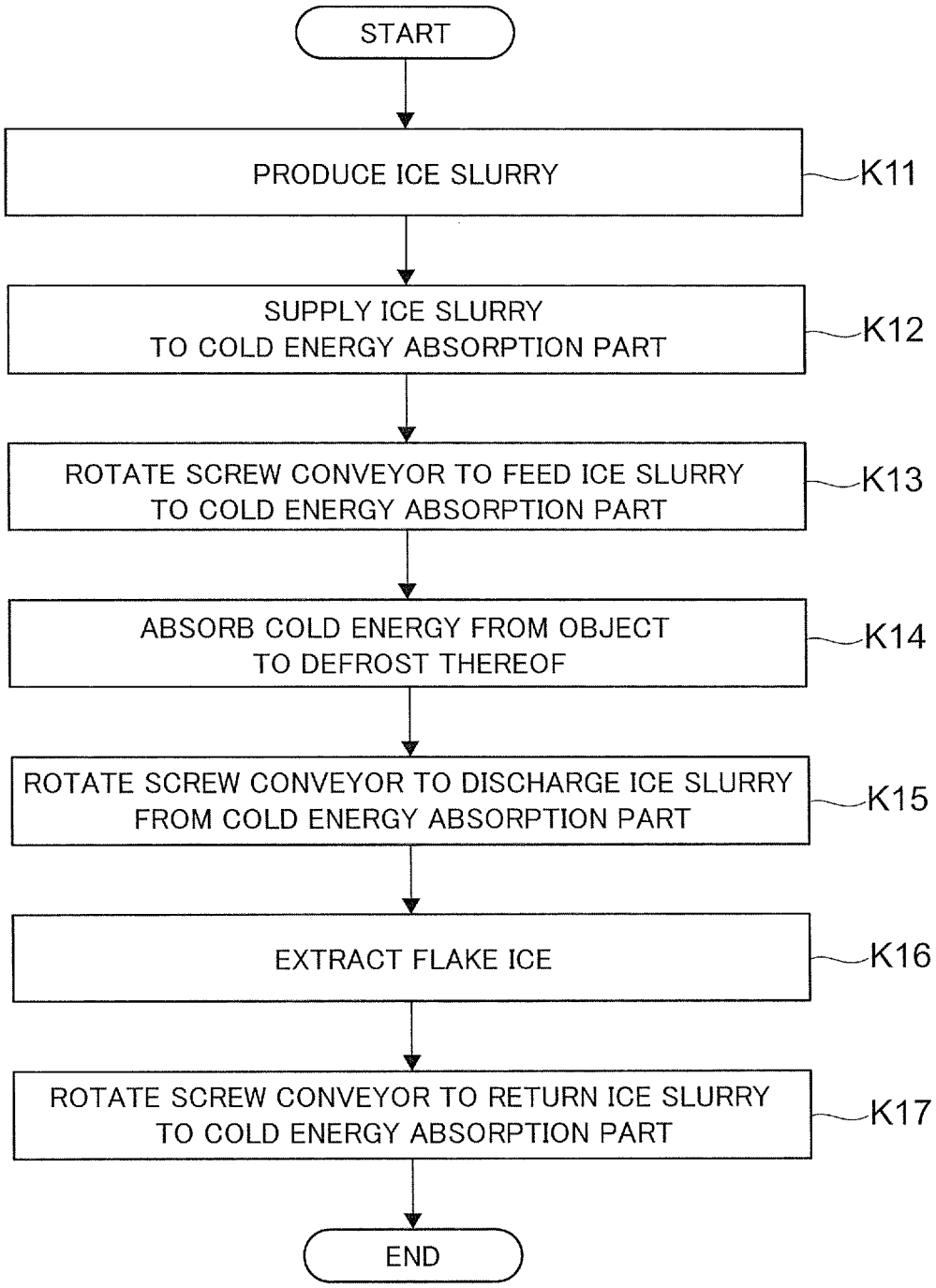
FIG. 11 is a flowchart illustrating a flow of a defrosting process performed by the state change control device in FIGS. 10A and 10B.

FIG. 11 is a flowchart illustrating the flow of the process performed by the state change control device 1 having the above-described configuration.

As shown in FIG. 11, the state change control device 1 performs a series of steps as follows to absorb the cold energy from the fish 201 fastened to the object fastening part 51 and defrost the fish 201.

In step K11, the ice slurry production part 15 mixes the flake ice produced by the flake ice production device 200 and the brine used as the raw material of the flake ice at a predetermined proportion, to thereby produce the ice slurry S.

In step K12, the ice slurry supply part 12 supplies the ice slurry S produced in the step K11 to the ice slurry contact part 11 via the ice slurry circulation part 13.

In step K13, the ice slurry circulation part 13 rotates the screw conveyor 52 to feed the ice slurry S supplied from the ice slurry supply part 12 to the ice slurry contact part 11.

In step K14, the ice slurry contact part 11 brings the fish 201 fastened to the object fastening part 51 for fastening the fish 201 into contact with the ice slurry S flowing inside the ice slurry contact part 11 at the predetermined relative speed, to thereby cause the ice slurry S to absorb the cold energy from the fish 201 and defrost the fish 201.

In step K15, the ice slurry circulation part 13 rotates the screw conveyor 52 to discharge the ice slurry S from the ice slurry contact part 11, the ice slurry S having been passed through while being in contact with or not being in contact with the fish 201 in the ice slurry contact part 11.

In step K16, the extraction part 14 extracts a part of the flake ice contained in the ice slurry S discharged from the ice slurry contact part 11 in the step K15 and provides the flake ice to the ice slurry production part 15 as the raw material used for producing the ice slurry S.

In step K17, the ice slurry circulation part 13 rotates the screw conveyor 52 to return the ice slurry S discharged from the ice slurry contact part 11 in the step K15 to the ice slurry contact part 11. Note that a part of the flake ice in the ice slurry S discharged from the ice slurry contact part 11 is extracted by the extraction part 14 in the step K16. Thus, the process is finished.

Figure 12:
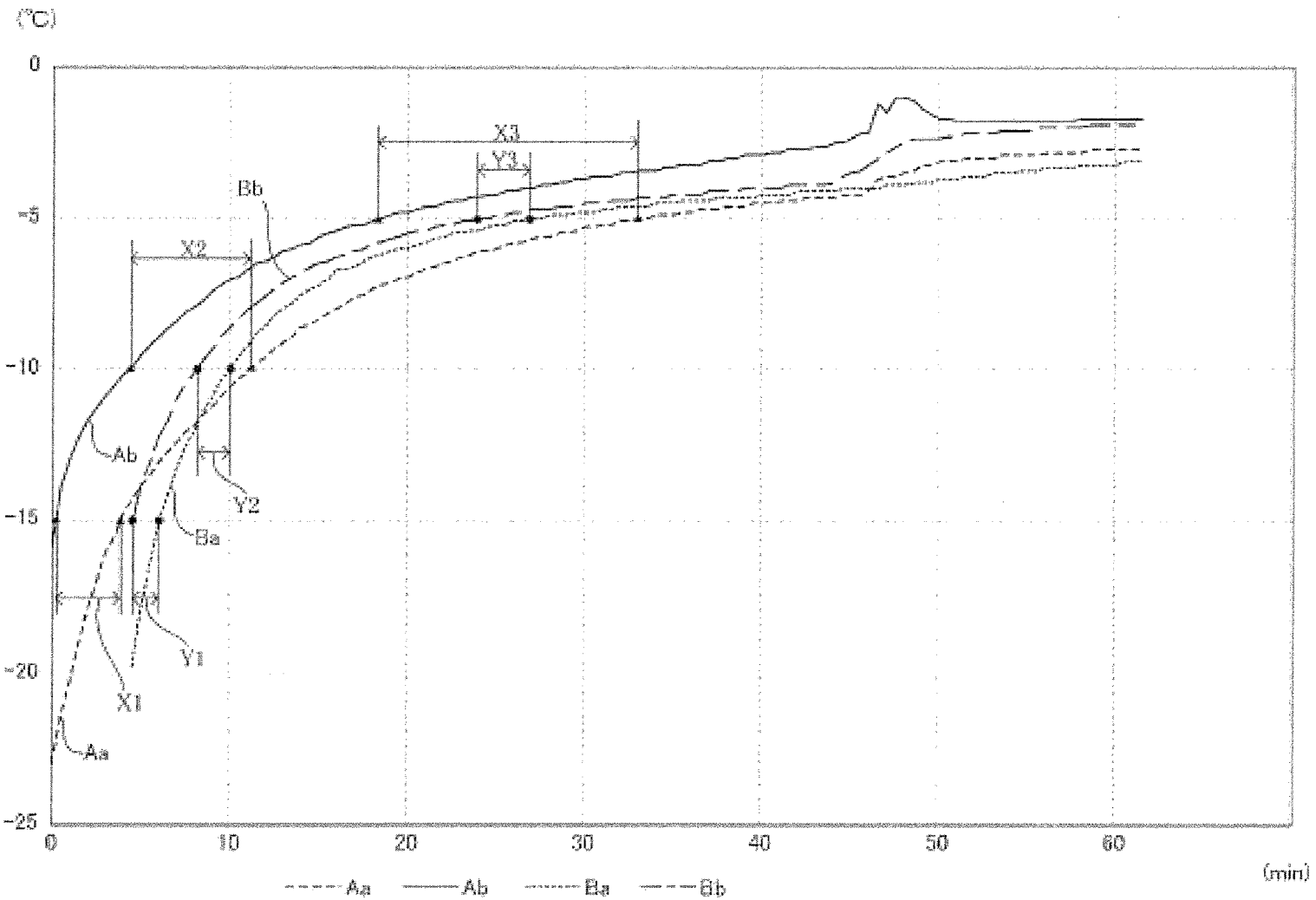
FIG. 12 is a graph showing temperature changes in a fish body in the case where the fish frozen at −21° C. is defrosted by being immersed in the stored ice slurry and in the case where the fish is defrosted by use of the defrosting function of the state change control device in FIGS. 10A and 10B.

FIG. 12 is a graph showing temperature changes in a fish body in the case where the fish frozen at −21° C. is defrosted by being immersed in the stored ice slurry and in the case where the fish is defrosted by use of the state change control device 1.

The vertical axis of the graph in FIG. 12 indicates the temperature (° C.) in the fish body and the horizontal axis indicates time (minutes).

Here, the curve Aa indicates the temperature inside the fish body shown by the thermometer a (refer to FIG. 8) disposed at the position of 8 cm from the surface of the body of the fish 201 in the case where the fish 201 frozen at −21° C. is immersed in the stored ice slurry and defrosted.

The curve Ab indicates the temperature inside the fish body shown by the thermometer b (refer to FIG. 8) disposed at the position of 2 cm from the surface of the body of the fish 201 in the case where the fish 201 frozen at −21° C. is immersed in the stored ice slurry and defrosted.

The curve Ba indicates the temperature inside the fish body shown by the thermometer a (refer to FIG. 8) disposed at the position of 8 cm from the surface of the body of the fish 201 in the case where the fish 201 frozen at −21° C. is defrosted by use of the state change control device 1.

The curve Bb indicates the temperature inside the fish body shown by the thermometer b (refer to FIG. 8) disposed at the position of 2 cm from the surface of the body of the fish 201 in the case where the fish 201 frozen at −21° C. is defrosted by use of the state change control device 1.

In other words, if the thermometer a measuring at a position far from the surface of the fish body and the thermometer b measuring at a position near the surface of the fish body are compared, needless to say, the thermometer b measuring at a position near the surface of the fish body is likely to be affected by external temperature changes; therefore, the temperature rises more quickly in the thermometer b than the thermometer a measuring at a position far from the surface of the fish body. In addition, between the thermometers a and b, the cells of the fish 201 are less likely to be destroyed and suffer less quality degradation by defrosting with smaller temperature difference.

First, a time difference between the timings when temperatures at the respective positions inside the body of the fish 201 frozen at −21° C. reach −15° C. due to absorption of the cold energy is observed. Then, in the case where the fish 201 is immersed in the stored ice slurry S, a time difference X1 occurs between the thermometers a and b. In contrast thereto, in the case where the state change control device 1 is used, merely a time difference Y1 occurs between the thermometers a and b.

In addition, a time difference between the timings when temperatures at the respective positions inside the body of the fish 201 frozen at −21° C. reach −10° C. due to absorption of the cold energy is observed. Then, in the case where the fish 201 is immersed in the stored ice slurry S, a large time difference X2 occurs between the thermometers a and b. In contrast thereto, in the case where the state change control device 1 is used, merely a time difference Y2 occurs.

Further, a time difference between the timings when temperatures at the respective positions inside the body of the fish 201 frozen at −21° C. reach −5° C. due to absorption of the cold energy is observed. Then, in the case where the fish 201 is immersed in the stored ice slurry S, a still large time difference X3 occurs between the thermometers a and b. In contrast thereto, in the case where the state change control device 1 is used, merely a time difference Y3 occurs between the thermometers a and b.

As described above, it can be learned that, between the case where the fish 201 frozen at −21° C. is immersed in the stored ice slurry and the case where the state change control device 1 is used, the temperature difference between the respective positions inside the fish body is smaller in using the state change control device 1. In other words, when the fish 201 is defrosted by use of the state change control device 1, the cells of the fish 201 are less likely to be destroyed and suffer less quality degradation by defrosting.

Next, with reference to FIG. 13, the bulk density (the void ratio) of the flake ice (the hybrid ice) used in the state change control device 1 having the above-described configuration will be described.

FIG. 13 is a diagram showing experimental results related to the bulk density of the flake ice (the hybrid ice) under various kinds of conditions. Moreover, in FIG. 13, the void ratios obtained by the following expression (1) are shown.

$$\text{Void ratio}=1-(\text{bulk density of hybrid ice/density of ice having the same concentration})=1-(\text{bulk density of hybrid ice}/(\text{density of ordinary ice } (0.92\ \text{g/cm}^3))\times(1+\text{salt concentration }(\%)/100)) \quad (1)$$

As shown in FIG. 13, the higher the salt concentration is, the lower the temperature of the flake ice (the hybrid ice) becomes. At this time, the bulk density of the flake ice (the hybrid ice) gradually increases and the void ratio thereof gradually decreases.

Specifically, when the salt concentration is 0.0%, the temperature of ice is 0.0° C. and the bulk density is 0.45 g/cm$^3$ (the void ratio is 51.1%); when the salt concentration is 1.0%, the temperature of ice is −1.0° C. and the bulk density is 0.50 g/cm$^3$ (the void ratio is 46.2%); when the salt concentration is 2.0%, the temperature of ice is −2.0° C. and the bulk density is 0.52 g/cm$^3$ (the void ratio is 44.6%); when the salt concentration is 5.0%, the temperature of ice is −6.3° C. and the bulk density is 0.60 g/cm$^3$ (the void ratio is 37.9%); when the salt concentration is 10.0%, the temperature of ice is −13.7° C. and the bulk density is 0.64 g/cm$^3$ (the void ratio is 36.8%); when the salt concentration is 15.0%, the temperature of ice is −19.9° C. and the bulk density is 0.70 g/cm$^3$ (the void ratio is 33.9%); when the salt concentration is 20.0%, the temperature of ice is −20.5° C. and the bulk density is 0.73 g/cm$^3$ (the void ratio is 33.8%); and when the salt concentration is 23.5%, the temperature of ice is −21.0° C. and the bulk density is 0.76 g/cm$^3$ (the void ratio is 33.1%).

Note that the numeric values shown in FIG. 13 are an example indicating relationship among the salt concentration, the temperature of ice and the bulk density (the void ratio), and are adjustable by changing the conditions. In other words, the above-described flake ice production system 300 can produce the flake ice (the hybrid ice) satisfying the optimum salt concentration, the temperature of ice and the bulk density (the void ratio) in accordance with the application purpose of the flake ice (the hybrid ice).

An embodiment of the present invention has been described above, but the present invention is not in any way limited to the configuration described in the above-described embodiment, and the present invention also includes other embodiments and modifications that can be considered within the scope of the matters described in the claims. In addition, various modifications and combinations thereof with the above-mentioned embodiment may be applied as long as they do not deviate from the gist of the present invention.

For example, salt water (aqueous solution of sodium chloride) was adopted as the brine in the above-described embodiment, but the brine is not particularly limited. Specifically, for example, it is possible to adopt an aqueous solution of calcium chloride, an aqueous solution of magnesium chloride, ethylene glycol, and the like. This makes it also possible to prepare plural kinds of brine having different solidifying points depending on the difference in solute or concentration.

In addition, in the above-described embodiment, the cold storage agent (the cold storage agents 101, 501 to 503) was adopted as the cooling object, but the cooling object is not particularly limited. Any material that is able to be frozen may be adopted as the cooling object. Examples of the cooling object include marine products, animal products and agricultural products.

Moreover, in the above-described embodiment, the fish 201 was adopted as the defrosting object, but the defrosting object is not particularly limited. Any frozen material that is able to be defrosted may be adopted as the defrosting object. Examples of the defrosting object include frozen marine products, frozen animal products and frozen agricultural products.

In addition, in the above-described embodiment, the flake ice contained in the ice slurry S discharged from the ice slurry contact part 11 is extracted by the extraction part 14, but the present invention is not limited to the configuration like this. For example, the optimum mixing ratio of the flake ice and the brine in the circulating ice slurry S may be kept by heating and melting the solid portion (the portion of flake ice) that has been subjected to temperature drop and solidified by contact with the defrosting object to convert thereof into the brine.

Summarizing the above, the state change control device to which the present invention is applied can take various embodiments as long as the device has the following configuration.

The state change control device (for example, the state change control device 1 in FIG. 6A or FIG. 10A) changes a state (for example, solidification (freezing) or melting (defrosting)) of an object (for example, the cold storage agent 101 in FIG. 6A or the fish 201 in FIG. 10A) by bringing the object into contact with an ice slurry (for example, the ice slurry S in FIG. 6A) to cause a temperature change (for example, cooling or absorption of the cold energy) to the object, and the device includes: an ice slurry contact unit (for example, the ice slurry contact part 11 in FIG. 6A) bringing the object into contact with the ice slurry at a predetermined relative speed to change a temperature of the object; and an ice slurry supply unit (for example, the ice slurry supply part 12 in FIG. 6A) supplying the ice slurry to the ice slurry contact unit.

This makes it possible to cause a state change to an object efficiently at low cost and in a short time.

Moreover, an ice slurry circulation unit (for example, the ice slurry circulation part 13 in FIG. 6A) circulating the ice slurry by feeding the ice slurry to the ice slurry contact unit and returning the ice slurry discharged from the ice slurry contact unit to the ice slurry contact unit can be further provided, and thereby the ice slurry contact unit can bring the ice slurry fed by the ice slurry circulation unit into contact with the object at the predetermined relative speed.

This makes it possible to cause a state change to an object efficiently at further low cost.

In addition, the ice slurry contact unit can further include an object oscillation unit (for example, the oscillating function provided to the object fastening part 51 in FIG. 6A) vibrating or oscillating the object.

This makes it possible to cause a state change to an object further efficiently.

Moreover, the object may be a cold storage agent (for example, the cold storage agent 101 in FIG. 6A) and the state change may be solidification caused by cooling the cold storage agent.

This makes it possible to freeze the cold storage agent efficiently at low cost and in a short time, which could not be achieved by the freezing technique based on the conventional air blast (air refrigeration) method.

In addition, the object may be a frozen food (for example, the fish 201 in FIG. 10A) and the state change may be melting caused by absorbing cold energy of the food.

This makes it possible to defrost the frozen object efficiently at low cost and in a short time without causing ice (frost) to adhere to the surface of the object.

Moreover, the ice slurry supply unit further includes: a flake ice production unit (for example, the flake ice production device 200 in FIG. 1) producing flake ice constituting the ice slurry; and an ice slurry production unit (for example, the ice slurry production part 15 in FIG. 6A) producing the ice slurry by mixing the flake ice produced by the flake ice production unit with brine (for example, the salt water) at a predetermined ratio, and the flake ice production unit includes an ice making surface (for example, the inner peripheral surface of the inner cylinder 32 in FIG. 1) and an ice making surface cooling unit (for example, the inner cylinder cooling refrigerant supplied to the refrigerant clearance 34 in FIG. 1), the flake ice production unit producing the flake ice by peeling off ice of the brine made by attaching the brine to the cooled ice making surface to freeze thereof.

Consequently, by the series of steps including the step of producing the flake ice to serve as the raw material of the ice slurry, it is possible to efficiently freeze or defrost the object.

Moreover, a brine extraction unit can be further provided, the unit extracting the brine contained in the ice slurry and providing the brine to at least one of the flake ice production unit and the ice slurry production unit as a raw material used for producing the flake ice or the ice slurry.

This makes it possible to keep the mixing ratio in the circulating ice slurry constant, and to efficiently reuse the brine obtained by melting the ice slurry.

In addition, a flake ice extraction unit can be further provided, the unit extracting the flake ice contained in the ice slurry and providing the flake ice to the ice slurry production unit as a raw material used for producing the ice slurry.

This makes it possible to keep the mixing ratio in the circulating ice slurry constant, and to efficiently reuse the flake ice obtained by freezing the brine in defrosting the object.

REFERENCE SIGNS LIST

1: State change control device
11: Ice slurry contact part
12: Ice slurry supply part
13: Ice slurry circulation part
14: Extraction part
15: Ice slurry production part
21: Drum
22: Rotary shaft
23: Spraying part
23*a*: Spraying hole
24: Peeling part
25: Blade
26: Flake ice discharge port
27: Upper bearing member
28: Spray control part
29: Heat insulating protective cover
30: Geared motor
31: Rotary joint
32: Inner cylinder
33: Outer cylinder
34: Refrigerant clearance
38: Bush
39: Refrigerant supply part
40: Brine storage tank
41: Pump
42: Brine tube
43: Brine tank
44: Flake ice storage tank
45: Refrigerant tube
46: Freezing point adjusting part
51: Object fastening part
52: Screw conveyor
101, 501, 502, 503: Cold storage agent
111: Main body part
112: Refrigerant
200: Flake ice production device
201: Fish
300: Flake ice production system
S: Ice slurry
W: Membrane

The invention claimed is:

1. A state change control device configured to change a state of an object by bringing the object into contact with an ice slurry to change a temperature of the object, the state change control device comprising:

an ice slurry contact tank configured to bring the object into contact with the ice slurry at a predetermined relative speed to change the temperature of the object;

a fastener configured to (i) fasten the object inside of the ice slurry contact tank, and (ii) vibrate or oscillate the fastened object inside of the ice slurry;

a flake ice maker configured to supply the ice slurry to the ice slurry contact tank, the flake ice maker comprising a sprayer, an ice making surface, and a coolant passage, the sprayer including a plurality of pipes, each of the plurality of pipes having a spraying hole configured to spray a first supply of a liquid toward the ice making surface such that the liquid freezes onto the ice making surface, the flake ice maker being configured to produce flake ice by peeling off the liquid that has frozen onto the ice making surface; and an ice slurry mixer configured to produce hybrid ice by mixing the flake ice produced by the flake ice maker with a second supply of the liquid at a predetermined ratio, wherein the ice slurry contains the hybrid ice, the liquid containing a solute, and the hybrid ice satisfying the following conditions (a) and (b):

(a) a temperature of the hybrid ice after melting completely is lower than 0° C.; and (b) a rate of change of solute concentration in an aqueous solution to be generated from the hybrid ice in a melting process is 30% or less.

2. The state change control device according to claim 1, further comprising:

an ice slurry circulation conveyor configured to circulate the ice slurry by feeding the ice slurry to the ice slurry contact tank and returning the ice slurry discharged from the ice slurry contact tank to the ice slurry contact tank, wherein the ice slurry contact tank brings the ice slurry fed by the ice slurry circulation conveyor into contact with the object at the predetermined relative speed.

3. The state change control device according to claim 2, wherein the ice slurry circulation conveyor is a screw conveyor.

4. A state change control method for changing a state of an object by bringing the object into contact with an ice slurry to change a temperature of the object, the method comprising:

a flake ice making step including spraying, using a sprayer including a plurality of pipes each having a spraying hole configured to spray a first supply of a liquid toward an ice making surface, the liquid onto the ice making surface such that the liquid freezes on the ice making surface, and producing flake ice by peeling off the liquid that has frozen onto the ice making surface;

a hybrid ice producing step producing hybrid ice by mixing the flake ice with a second supply of the liquid at a predetermined ratio;

an object fastening step fastening the object inside of an ice slurry contact tank;

an ice slurry contact step bringing the object into contact with the ice slurry at a predetermined relative speed to change the temperature of the object;

a vibrating or oscillating step vibrating or oscillating the fastened object inside of the ice slurry; and an ice slurry supply step supplying the ice slurry, wherein the ice slurry contains the hybrid ice, the liquid containing a solute, and the hybrid ice satisfying the following conditions (a) and (b):

(a) a temperature of the hybrid ice after melting completely is lower than 0° C.; and (b) a rate of change of solute concentration in an aqueous solution to be generated from the hybrid ice in a melting process is 30% or less.

5. The state change control device according to claim 1, wherein the object is a cold storage agent, and the change of the state is solidification caused by cooling the cold storage agent.

6. The state change control device according to claim 1, wherein the object is a frozen food, and the change of the state is melting caused by absorbing cold energy of the food.

7. The state change control device according to claim 1, wherein the liquid is brine.

8. The state change control device according to claim 7, further comprising:

a brine separator configured to extract the brine contained in the ice slurry and provide the brine to at least one of the first supply and the second supply as a raw material used for producing the flake ice or the ice slurry.

9. The state change control device according to claim 7, further comprising:

a flake ice separator configured to extract the flake ice contained in the ice slurry and provide the flake ice to the ice slurry mixer as a raw material used for producing the ice slurry.

10. The method according to claim 4, wherein in the ice slurry contact step, the ice slurry is circulated using a screw conveyor.

11. The state change control method according to claim 4, wherein the object is a cold storage agent, and the change of the state is solidification caused by cooling the cold storage agent.

12. The state change control method according to claim 4, wherein the object is a frozen food, and the change of the state is melting caused by absorbing cold energy of the food.

* * * * *